US006037908A

United States Patent [19]

Phillips et al.

[11] Patent Number: 6,037,908

[45] Date of Patent: Mar. 14, 2000

[54] MICROWAVE ANTENNA

[75] Inventors: Chester C. Phillips; John Lovberg, both of San Diego; Randall Olsen, Carlsbad; Ri-Chee Chou, San Diego, all of Calif.

[73] Assignee: Thermotrex Corporation, San Diego, Calif.

[21] Appl. No.: 08/756,756

[22] Filed: Nov. 26, 1996

[51] Int. Cl.[7] ..... H01Q 19/08

[52] U.S. Cl. ..... 343/753; 343/754; 343/785

[58] Field of Search ..... 343/753, 754, 343/770, 771, 780, 785; H01Q 15/00, 19/08

[56] References Cited

U.S. PATENT DOCUMENTS

| | | | |
|---|---|---|---|
| 4,187,507 | 2/1980 | Crane et al. | 343/754 |
| 4,647,940 | 3/1987 | Traut et al. | 343/770 |
| 4,873,481 | 10/1989 | Nelson et al. | 324/640 |
| 5,121,124 | 6/1992 | Spivey et al. | 342/179 |
| 5,173,714 | 12/1992 | Arimura et al. | 343/771 |
| 5,177,496 | 1/1993 | Arimura et al. | 343/771 |
| 5,486,837 | 1/1996 | Miller | 343/780 |
| 5,565,237 | 10/1996 | Johnson et al. | 342/179 |

OTHER PUBLICATIONS

Johnson, et al., "Passive Microwave Camera", ThermoTrex Corporation, San Diego, California, pp. 1–4.

Lovberg, et al., "Advances in real–time millimeter–wave imaging radiometers for avionic synthic vision", ThermoTex Corporation, San Diego, California, pp. 1–8.

Lovberg, et al.; Wikner, et al., "Application of Sparse Phased Arrays to Millimeter–Wave Radiometry", ThermoTrex Corporation and Army Research Laboratory, San Diego, California; Adelphi, Maryland, pp. 1–4.

Lovberg, et al., "Real–Time Millimeter–Wave Imaging Radiometer for Avionic Synthetic Vision", ThermoTrex Corporation, San Diego, California, pp. 1–11.

Young, et al., "Passive millimeter–wave imaging", TRW Space & Defense, Quest, Winter 1990–91, pp. 1–14.

*Primary Examiner*—Michael C. Wimer
*Attorney, Agent, or Firm*—Fish & Richardson P.C.

[57] ABSTRACT

A low cost microwave antenna. Microwaves are radiated from or collected by a thin layer radiating-collecting microwave guide section in which a dielectric slab is sandwiched between a metallic bottom plate and a metallic radiating-collecting cover plate. The cover plate contains a large number of slots spaced to produce outgoing or define incoming microwaves beams having directions determined: (1) by the directions of propagation of microwave radiation within the radiating-collecting microwave section and (2) by the frequency of the radiation. In a collection mode, a microwave lens focuses microwave radiation propagating in the waveguide section at focal locations which are dependent on the direction of propagation of the radiation in the waveguide. Alternatively, in a radiation mode, the lens converts microwave energy broadcast from said focal locations into parallel beams propagating in the radiating-collecting microwave guide section.

42 Claims, 21 Drawing Sheets

BEAM POINTING vs. FREQUENCY

RADIATION ANGLE vs. INPUT ANGLE

MICROWAVE ANTENNA

The present invention relates to antennas and especially to directional microwave antennas.

BACKGROUND OF THE INVENTION

Microwave radiation is generally defined as that electromagnetic radiation having wavelengths between radio waves and infrared radiation. There is no sharp division but for this application we will use the phrase microwave radiation to define that band of electromagnetic radiation having wavelengths between 3 $\mu$m and 30 cm corresponding to frequencies of about 1 GHz to about 1,000 GHz.

Microwave radiation can be forced to travel in specially designed waveguides. Microwave radiation can be transmitted through space or through the atmosphere in a microwave beam from a microwave antenna and the microwave energy can be collected with a microwave antenna.

Objects in the environment emit and reflect microwave radiation at various wavelengths within the microwave spectrum. The intensity of emission and reflection from an object depend on the object's temperature, composition and various other factors. As a consequence, images of objects can be obtained by utilizing a microwave antenna capable of measuring microwave intensity as a function of direction. Such devices are sometimes referred to as microwave cameras. Some of the Applicants were co-inventors of microwave cameras described in U.S. Pat. No. 5,365,237 issued on Nov. 15, 1994 and U.S. Pat. No. 5,121,124 issued on Jun. 9, 1992, both of which patents are incorporated herein by reference.

Many antennas currently exist for transmitting and receiving microwave radiation. Microwave antenna used for communication are very common. These devices typically comprise an open ended waveguide and a parabolic reflector or horn and they typically transmit a predetermined frequency in a predetermined direction. A good description of prior art antennas is found in Antenna Engineering Handbook, edited by Johnson and Janik and published by McGraw-Hill Book Company with offices in New York, N.Y.

It is well known that the beam direction of some types of antenna can be altered or "scanned" in one dimension by adjusting the frequency (or wavelength) of the microwave energy being transmitted or in one dimension the frequency of the microwave energy being detected. Some of these frequency scannable antennas are listed in U.S. Pat. No. 5,365,237 and that list is repeated here:

a) Waveguide antenna with slots b) Helical transmission line with taps c) Dielectric rod transmission line with taps d) Transmission grating e) Reflecting grating f) Dispersive prism g) Parallel plate transmission line with taps h) Dielectric slot transmission line with taps i) Stripline with taps j) Microstrip with taps k) Individual antennas interconnected with delavs lines Another type of microwave antenna is the flat slot array antenna. Two such antennas are described in U.S. Pat. No. 5,173,714 issued Dec. 22, 1992 to Arimura et al and U.S. Pat. No. 5,177,496 issued on Jan. 5, 1993 to Arimura et al. These antennas appear to have been designed for use in microwave broadcasting of a microwave beam in a predetermined direction and contain no teaching regarding beam scanning. These prior art flat slot arrays have thicknesses of at least $\lambda$ (the antenna nominal wavelength) or greater and operate in a TE mode. Flat antennas with an effective thickness of $\lambda$ are herein referred to a resonant antenna.

What is needed is a better low cost microwave antenna that can be scanned in two dimensions and can be utilized for microwave imaging.

SUMMARY OF THE INVENTION

The present invention provides a low cost microwave antenna. Microwaves are radiated from or collected by a thin layer radiating-collecting microwave waveguide section in which a dielectric slab is sandwiched between a metallic bottom plate and a metallic radiating-collecting cover plate. The cover plate contains a large number of slots spaced to produce outgoing or define incoming microwave beams having directions determined: (1) by the directions of propagation of microwave radiation within the radiating-collecting microwave waveguide section and (2) by the frequency of the radiation. In a collection mode, a microwave lens focuses single frequency microwave radiation propagating in the waveguide section at focal locations which are dependent on the direction of propagation of the radiation in the waveguide section. Alternatively, in a radiation mode, the lens converts microwave energy broadcast from said focal locations into parallel beams propagating in the radiating-collecting microwave waveguideguide section. Preferred embodiments of the present invention have slots with major dimensions in the range of 0.1 $\lambda$ to 0.4 $\lambda$ (where $\lambda$ is the nominal wavelength for which the antenna is designed) and are referred to herein as subresonant antenna.

DETAILED DESCRIPTION OF PREFERRED EMBODIMENTS

A preferred embodiment of the present invention can be described by reference to FIGS. 1–18. The antenna is used as a part of a microwave imaging system. Two dimensional microwave images are produced in which the intensity of collected microwave energy is analyzed to provide image information in a first dimension and the intensity values of microwave radiation at a large number of focal locations are analyzed to provide image information in a second dimension. In this preferred embodiment frequencies are analyzed utilizing a laser beam diffracted through a Bragg cell in which diffraction gratings are generated with an acoustic transducer utilizing signals carrying information contained in the collected microwave radiation.

Prototype Antenna

A prototype antenna actually built and tested by the Applicants for use in obtaining microwave images can be described by reference to drawings FIGS. 1A through 15B.

Parts and Assembly of Antenna

Figure 1A:
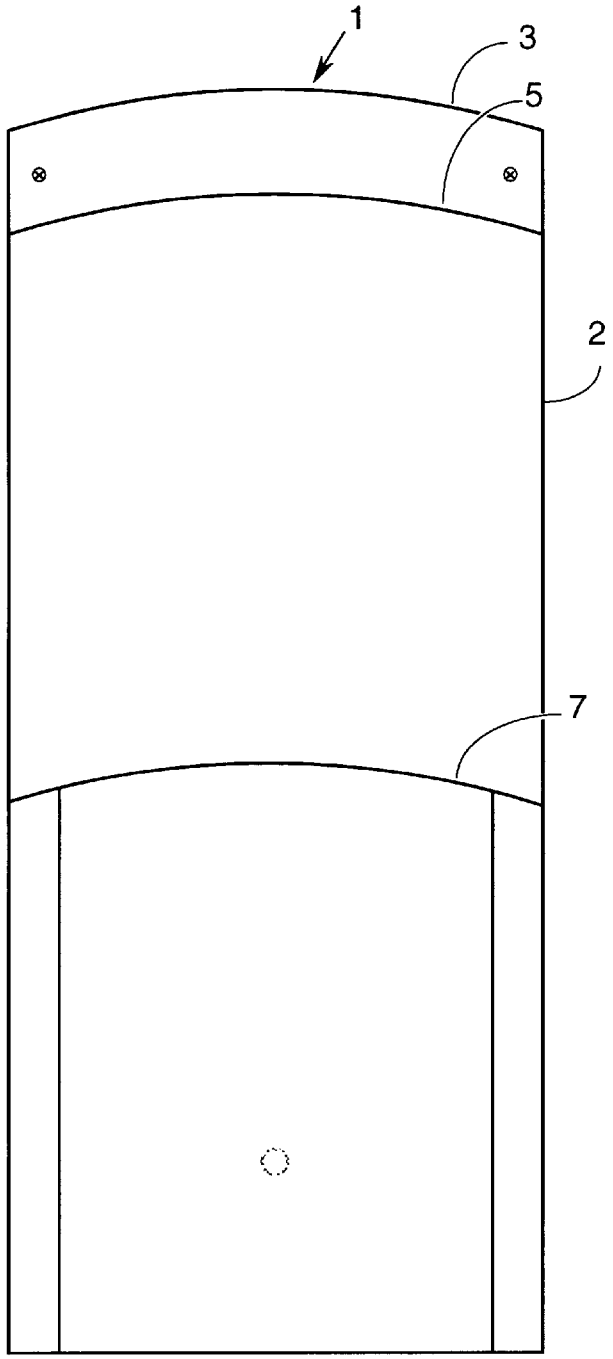
FIGS. 1A, 1B and 1C are three drawings showing three views of a support plate.
Figure 1B:
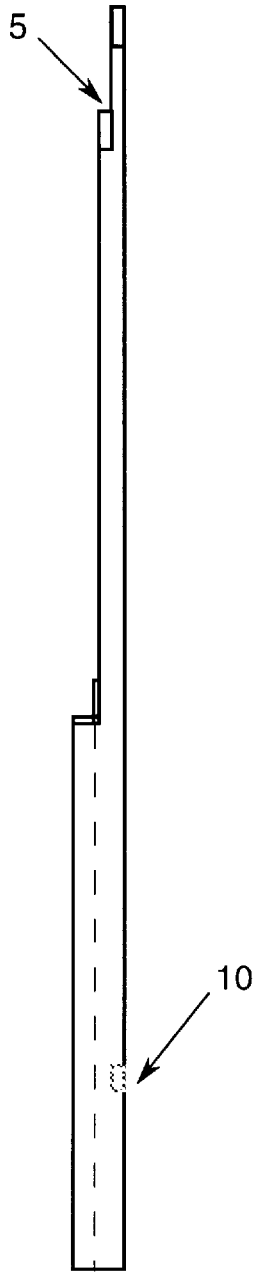
Figure 1C:
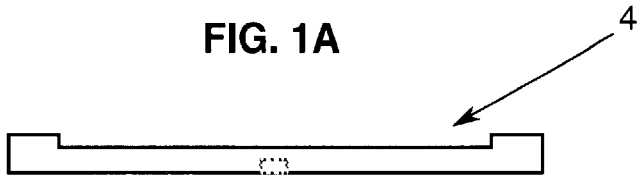

FIGS. 1A, 1B, and 1C show the top, side and end views of an aluminum support plate 2. The plate is about 14½ inches long and 5¼ inches wide. On one end, it provides a 4 inch wide slot 4 for the placement of a dielectric slab 9 shown in FIGS. 4A and 4B and copper radiating cover plate 8 shown in FIG. 5. A threaded screw hole 10 is located 2 inches from the lower edge of support plate 2 as shown in FIGS. 1A, 1B and 1C. One edge 3 of plate 2 forms an arc defined by an 11-inch radius from the center line of screw hole 10, and it has a first shelf edge 5 defined by a 10-inch radius from hole 10 and a second shelf edge 7 defined by a 4-inch radius from hole 10.

Figure 2A:
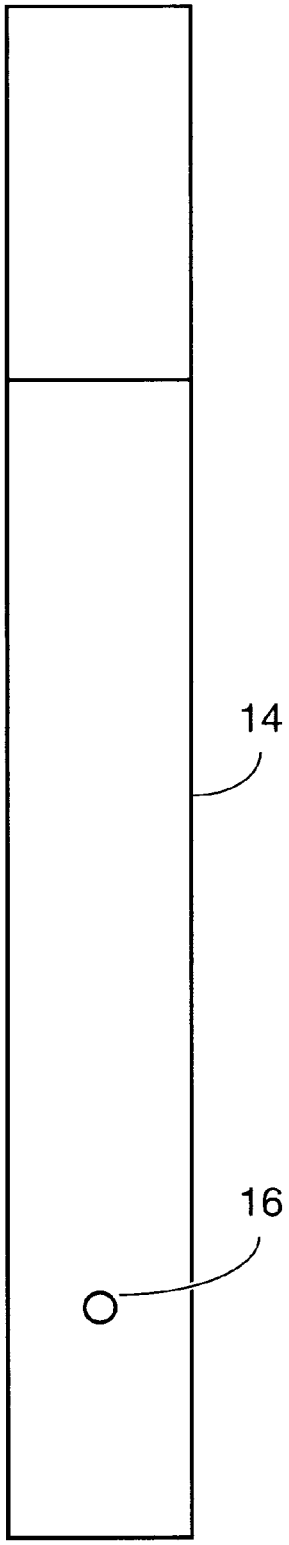
FIGS. 2A and 2B are drawings showing two views of a pivot arm.
Figure 2B:
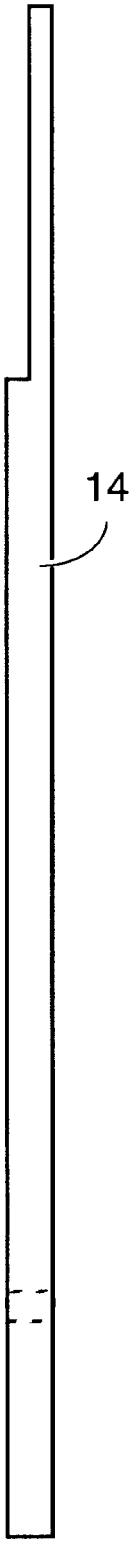
Figure 3A:
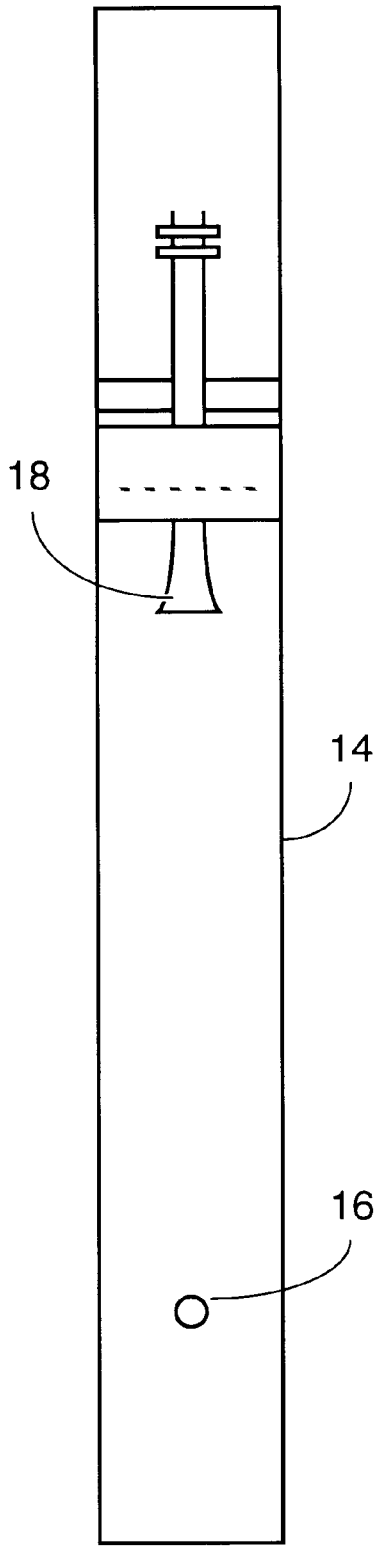
FIGS. 3A and 3B are drawings showing two views of the pivot with a horn mounted on it.
Figure 3B:
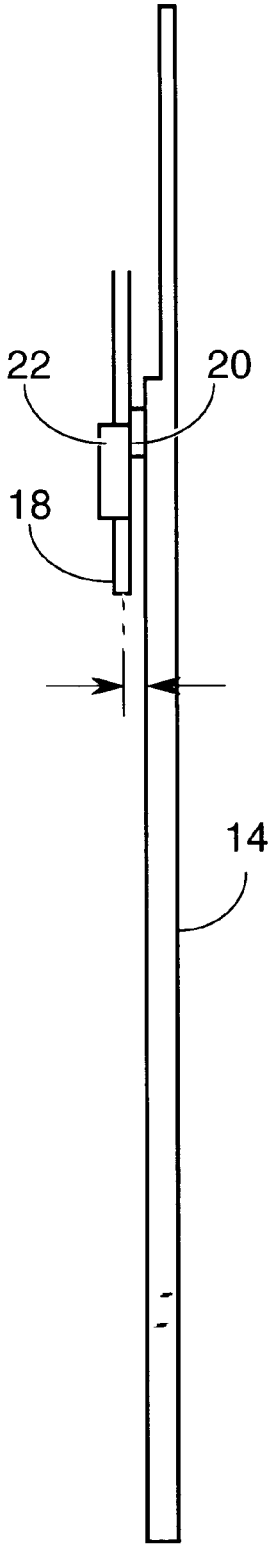

Two views of a pivot arm 14 are shown in FIGS. 2A and 2B. Arm 14 is comprised of aluminum and is 15 inches long with a pivot hole 16 drilled ¼ inch from its lower edge as shown in FIGS. 2A and 2B. Microwave horn 18 is mounted on pivot arm 14 as shown in FIGS. 3A and 3B with spacer 20 and cover plate 22 such that its mouth is located 10 inches from the center line of pivot hole 16.

Figure 4A:
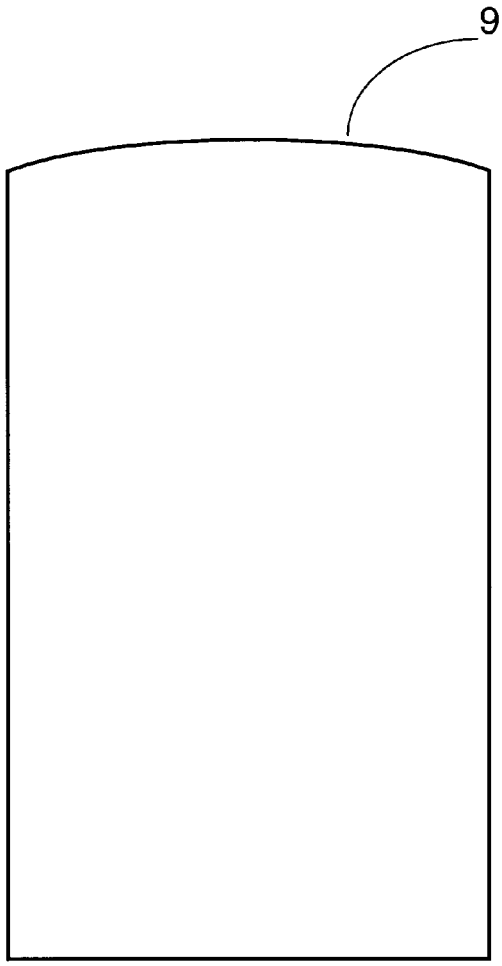
FIGS. 4A and 4B are two views of a dielectric slab.
Figure 4B:
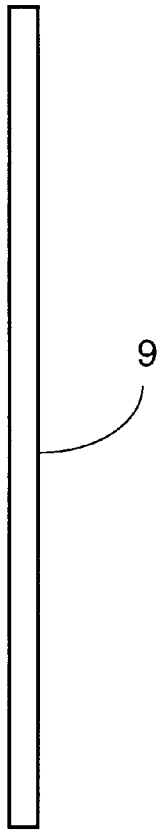

Dielectric slab 9 is shown in FIGS. 4A and 4B. It's comprised of 0.031 inch thick polystyrene sheet and the slab is 4 inches wide. It's two long edges span 6¼ inches. One of the short edges is straight and the other is an arc with a radius of 4 inches.

The dielectric slab 9 is placed in the 4-inch wide slot in the support plate 2 so that the circular cut edge of the slab faces the microwave horn on the focal plane and also so that the slab aligns with the 4 inch circular shelf edge 7 located in the support plate.

Figure 5:
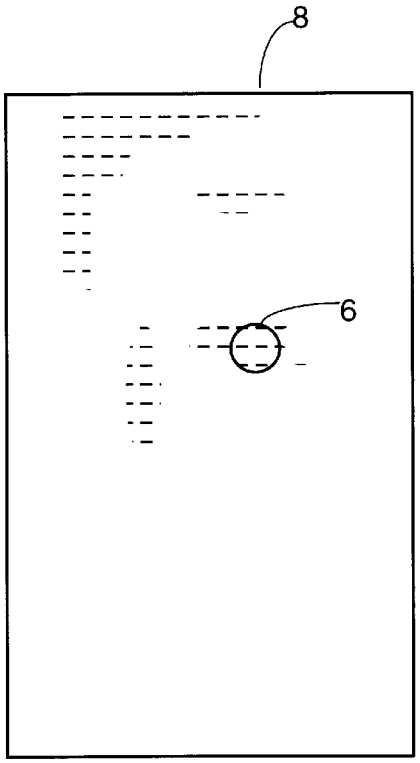
FIG. 5 is a drawing of a radiating-collection cover plate.
Figure 6:
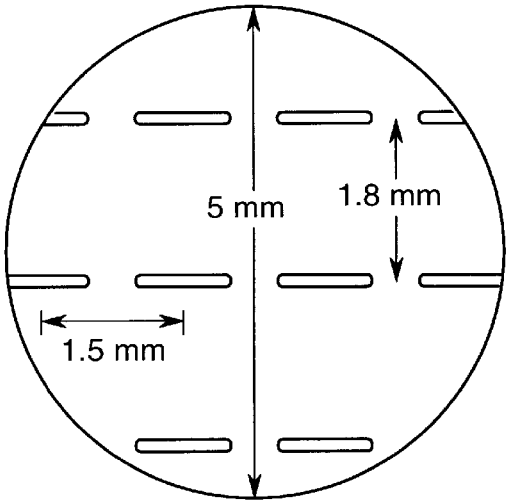
FIG. 6 is an enlarged view of a portion of the cover plate shown in FIG. 5.

Copper radiating cover plate 8 is shown in FIG. 5. It is comprised of a copper foil 0.2 mm thick, 4 inches wide and 6¼ inches long. Cut in it using a lithography process are 5628 slots having dimensions of about 0.1 mm×1.2 mm located on 1.8 mm centers in the 6½ inch direction and 1.5 mm centers in the 4 inch direction with the long slot dimension in the 4-inch direction. An enlargement of a circular section 6 of radiating cover plate 8 is shown in FIG. 6.

Figure 7A:
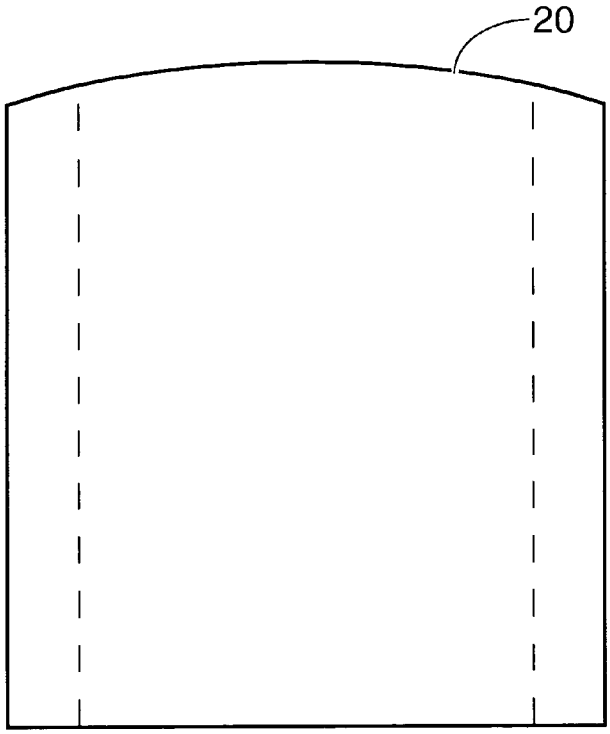
FIGS. 7A, 7B and 7C are three views of a top cover plate.
Figure 7B:
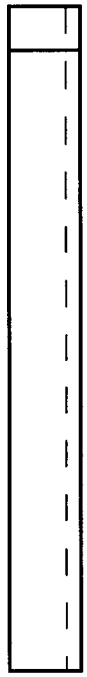
Figure 7C:
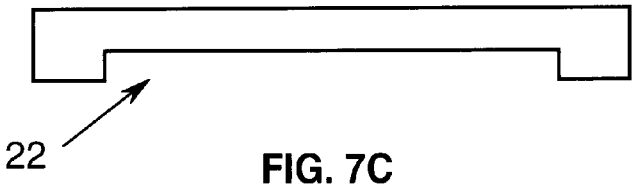
Figure 8A:
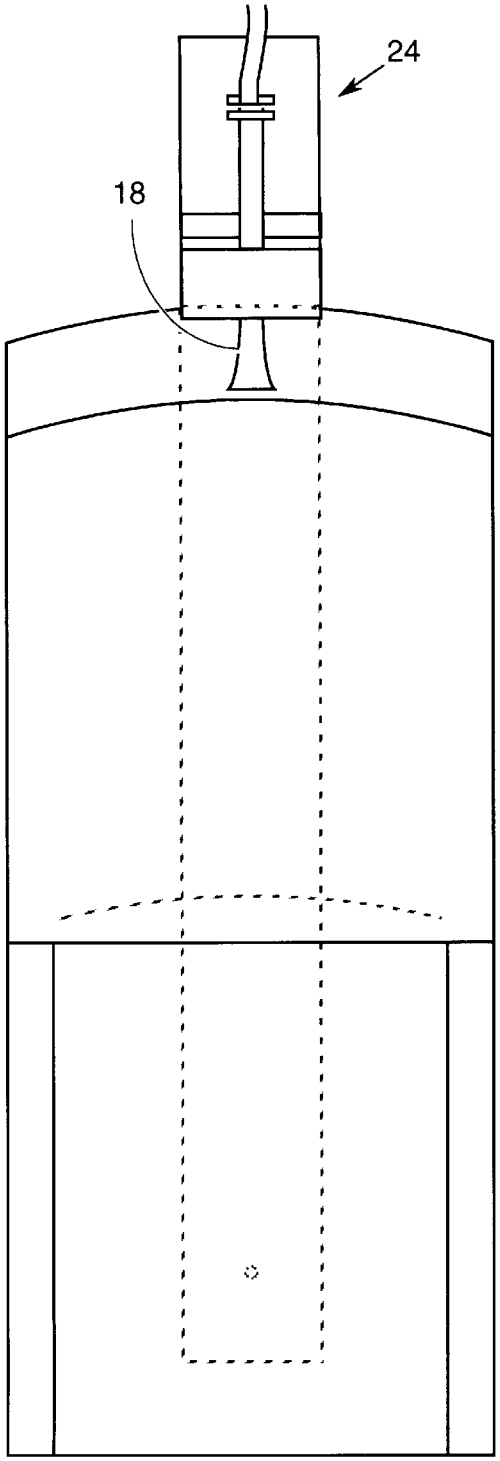
FIGS. 8A, 8B and 8C are three views of an assembled antenna.
Figure 8B:
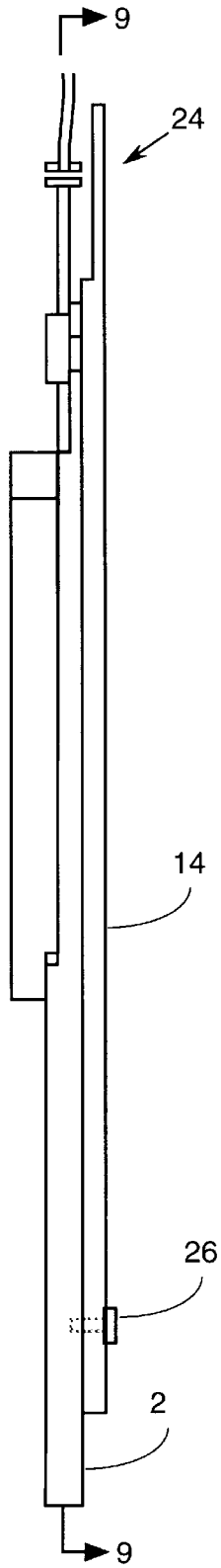
Figure 8C:
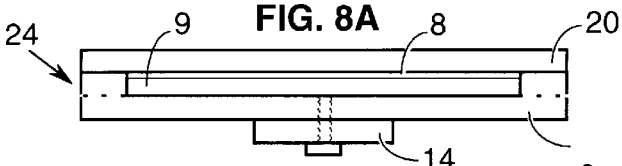

Aluminum top cover plate 20 is shown in FIGS. 7A, 7B and 7C. Two of its sides are parallel and 5 inches long and it is 5¼ inches wide with one straight side in its width direction. Its fourth side defines an arc having a 10 inch radius. Plate 20 is ¼ inch thick at its two long edges and has a 0.31 inch thick and 4 inch wide slot cut in its long direction as shown at 22 in FIG. 7C.

The assembled microwave antenna 24 is shown in FIGS. 8A, 8B and 8C, 9 and 10. Pivot arm 14 with microwave horn 18 is pivotally mounted on support plate or frame 2 with pivot screw 26 which is screwed into threaded screw hole 10 so the mouth of horn 14 pivots about hole 10 and always points in the direction of the center line of hole 10 as shown in FIG. 11 as pivot arm 14 pivots about the center line of hole 10.

Figure 9:
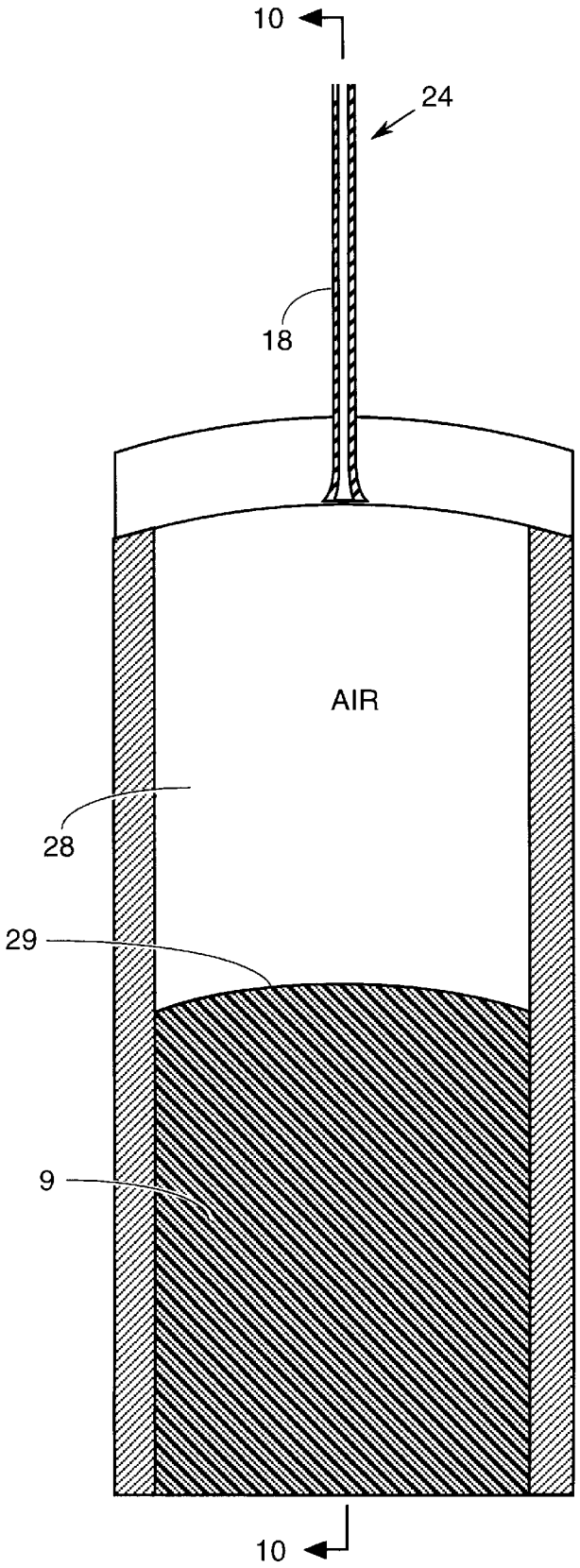
FIGS. 9A and 10 are cross section drawings of the antenna.
Figure 10:
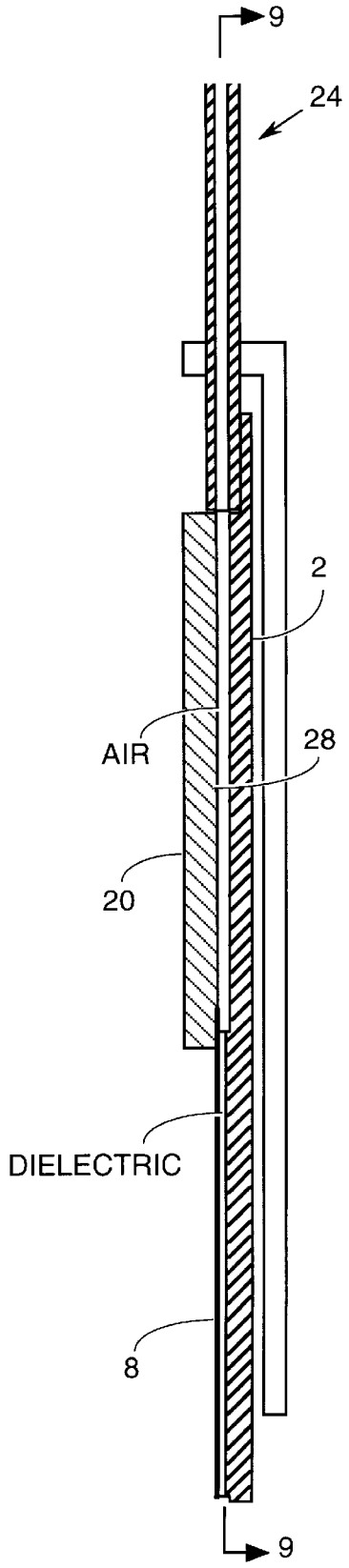
Figure 11:
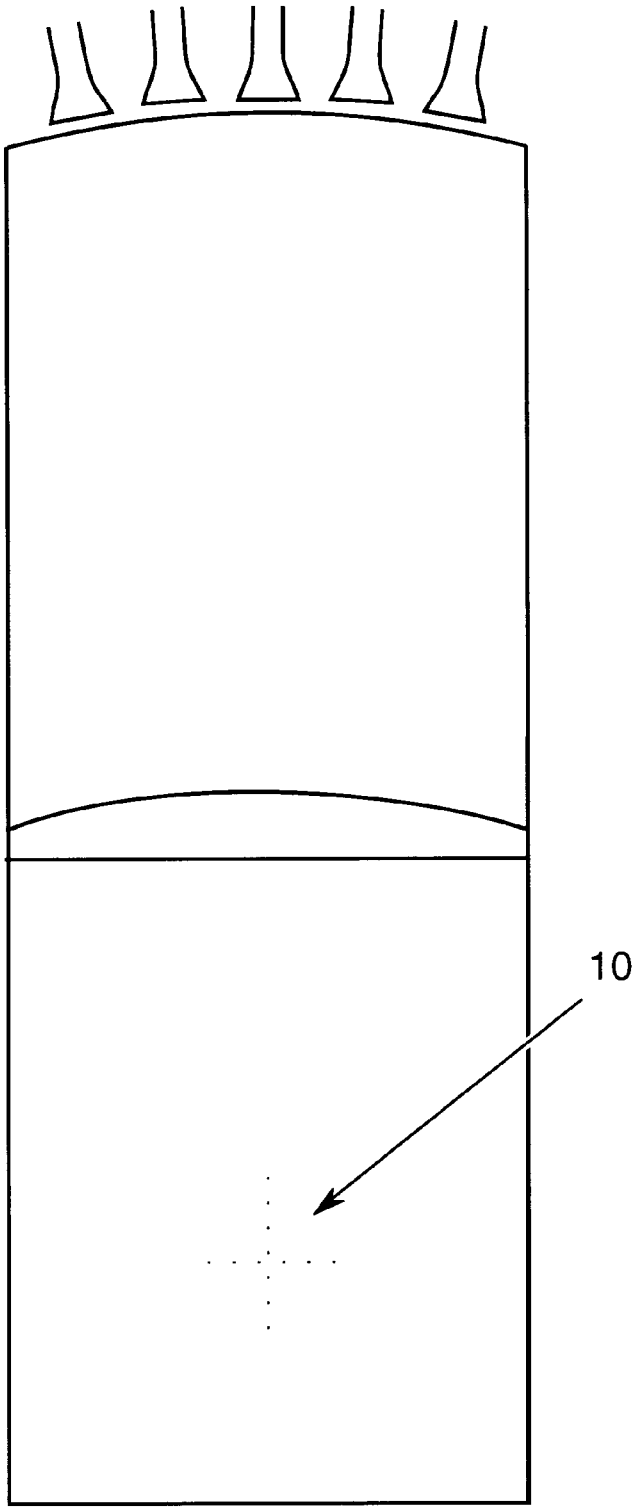
FIG. 11 is a drawing showing several horn positions.

FIGS. 9 and 10 show cross sections in perpendicular planes which include the center line of wave guide horn 18 in the position shown in FIG. 9. FIGS. 9 and 10 show important elements of antenna 24. Aluminum cover plate 20 and support plate 2 form an air dielectric parallel plate waveguide cavity 28 bounded on 4 sides by conducting aluminum. Dielectric slab 9 is bounded on three sides by aluminum support plate 2 and on one side by copper radiating cover plate 8. Edge 29 of dielectric slab 9 functions as a piano-convex microwave lens. The mouth of horn 18, air cavity 28 and dielectric slab 9 are aligned as shown in FIG. 10. With the dimensions as described above, the antenna is designed to focus microwave radiation in the range of about 80 GHz to 110 GHz traveling in the long direction of dielectric slab 9 into the mouth or horn 18 at the position shown in FIG. 9. Similarly 80 to 110 GHz radiation broadcast from the mouth of horn 18 will focus into a substantially parallel beam traveling through dielectric slab 9.

Figures 12A, 12B, 12C:
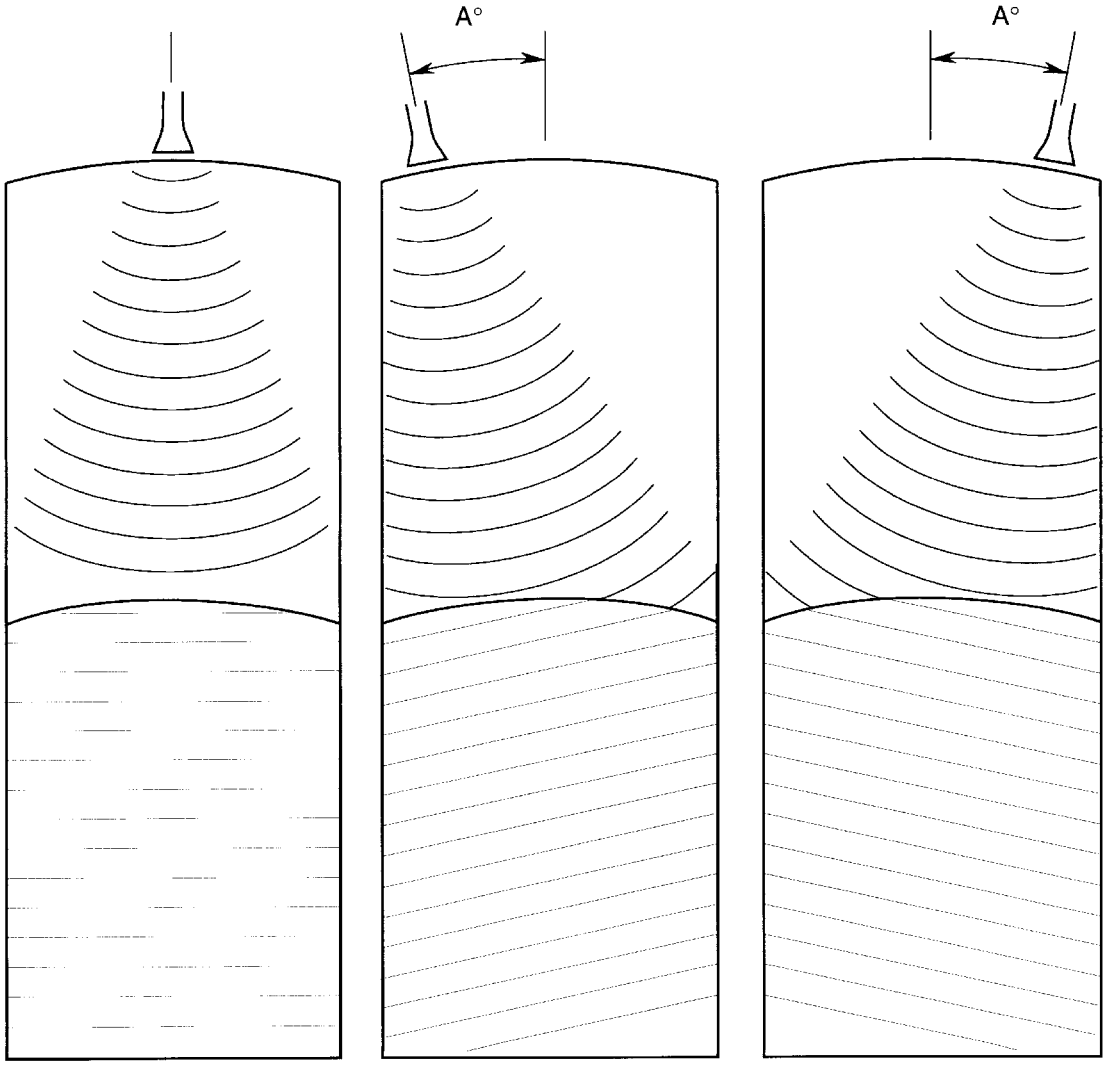
FIGS. 12A, 12B and 12C are drawings showing the function of a microwave lens in generating wave fronts and focusing under frequency microwave energy propagating in a radiating-collecting microwave waveguide.

The focusing features of edge 29 are graphically demonstrated in FIGS. 12A, 12B and 12C. As shown in these figures any position of horn 18 will produce a parallel beam in slab 9. However, the direction of the beam in slab 9 is a function of the position of the horn. When the horn is at the position shown in FIG. 12A the beam travels straight down slab 9. When the position of the horn is shifted to the left or right, the direction of the beam in slab 9 is as shown in FIGS. 12B or 12C.

Note also that the wavelengths of the microwave radiation are much shorter than the spacing between the parallel lines shown in FIGS. 12A, B and C. For example, a microwave frequency of 106 GHz would produce a wavelength in dielectric slab 9 of 1.8 mm which would result in a beam radiating perpendicularly out of copper radiating cover plate 9 as suggested by the spacings shown in FIG. 6.

Beam Pointing

Essentially all of the microwave energy in the beam traveling down dielectric slab 9 (i.e., in the transmit mode) will leak out of the slots in radiating copper cover plate 8 forming a microwave beam traveling out of the face of radiating copper plate 8. The direction of the beam in the vertical direction is determined by the frequency of the microwave radiation and the direction in the azimuthal direction is determined by the direction of the beam in dielectric slab 9 which is determined by the angular position of the mouth of horn 18. Specifically, these directions are as follows:

$$\alpha = \sin^{-1}\left[\frac{\frac{c}{f} - S \cdot E^{1/2}}{S}\right]$$

$$\gamma = \sin^{-1}[\epsilon^{1/2}\sin\theta]$$

where c=3.10$^{10}$ cm/sec (speed of light)

S=0.18 cm (longitudinal slot spacing)

F=signal frequency in Hz

∈=2.54 (dielectric constant of slab)

θ=angular position of horn in degrees (see FIG. 12).

Figure 14A:
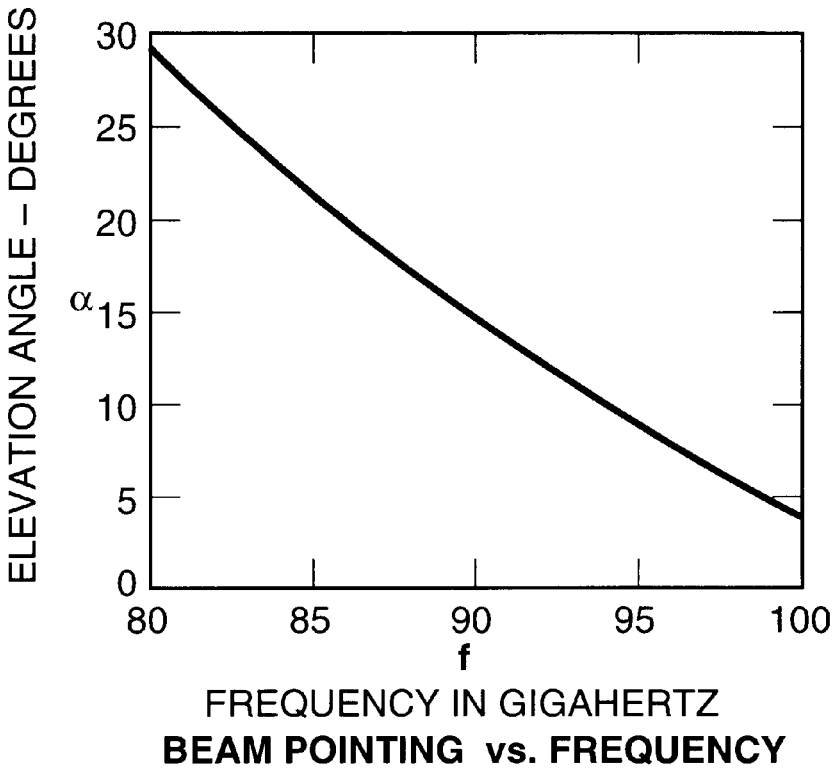
FIGS. 14A and 14B show charts of beam direction based on frequency and horn input angle for a preferred embodiment.
Figure 14B:
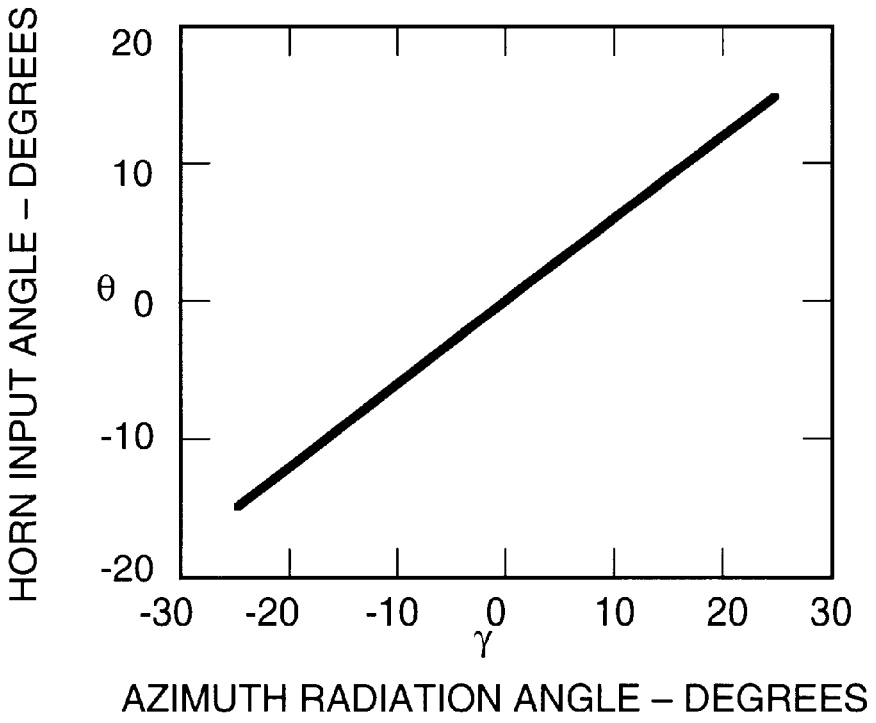

These relationships are shown graphically in FIGS. 14A and 14B.

Figure 13A:
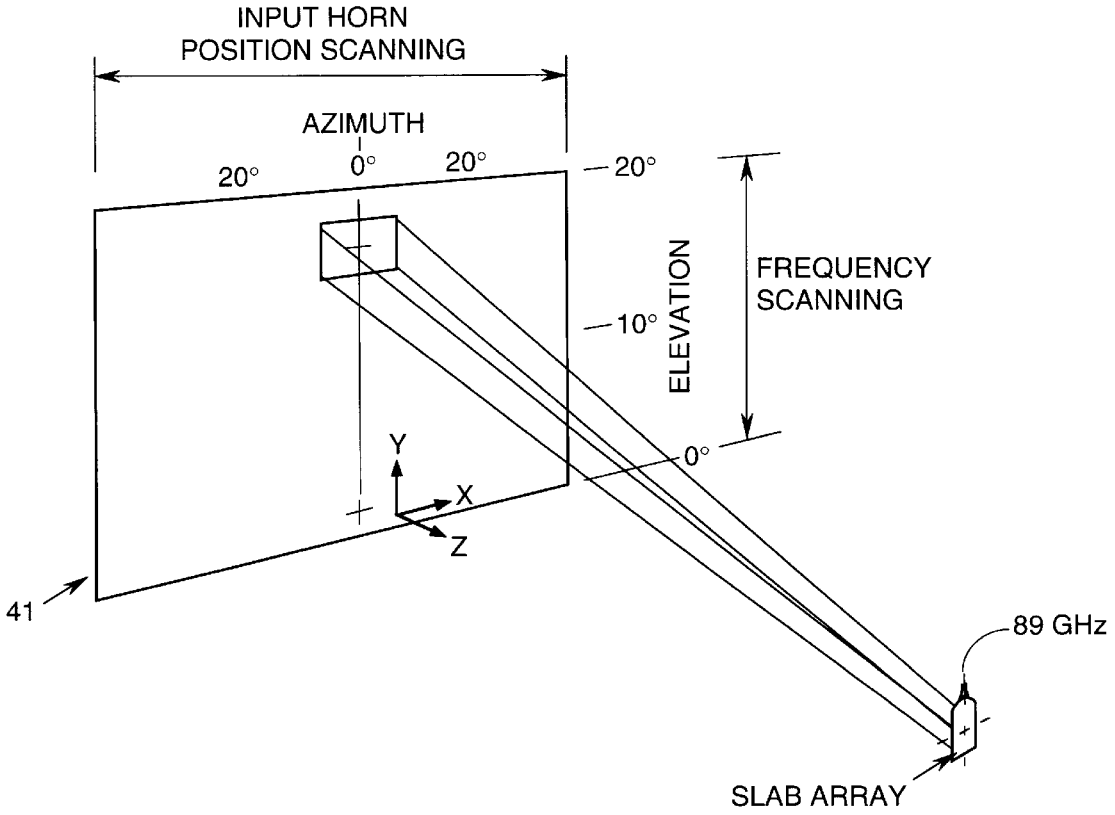
FIGS. 13A, 13B, 13C and 13D show how beams can be directed by a preferred embodiment.
Figure 13B:
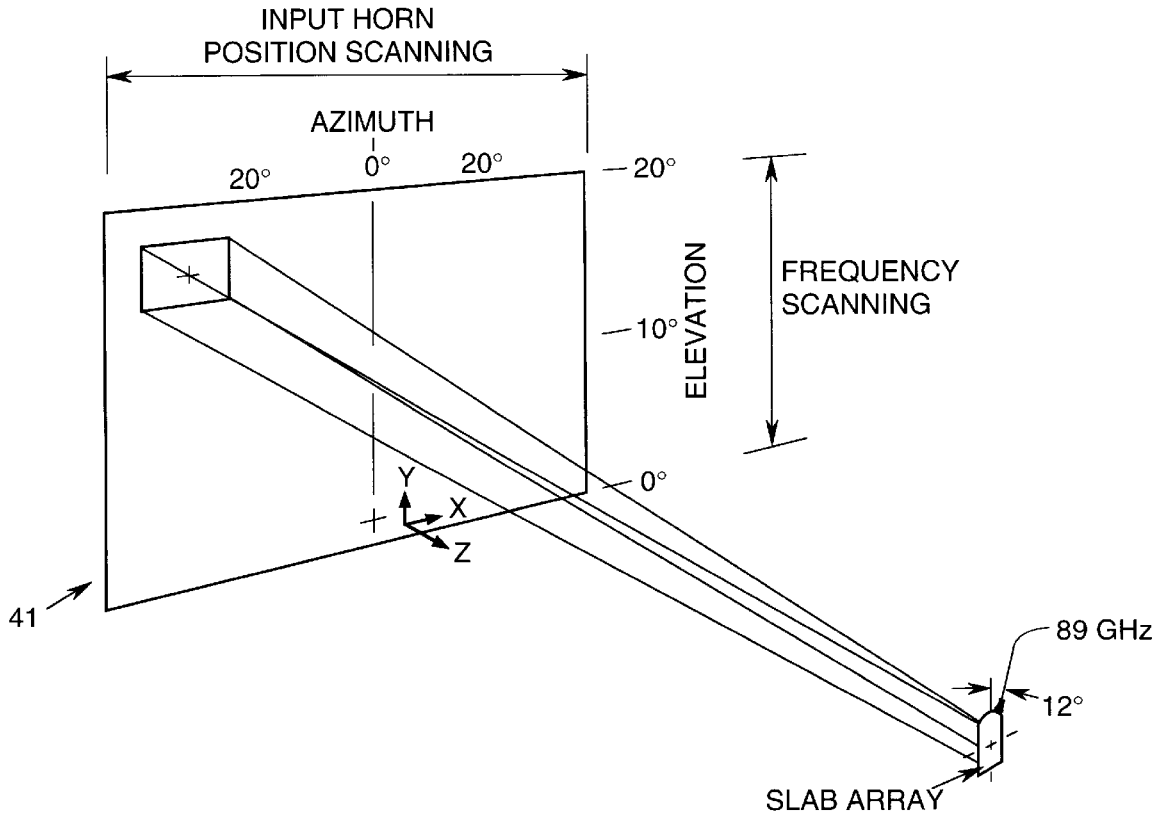
Figure 13C:
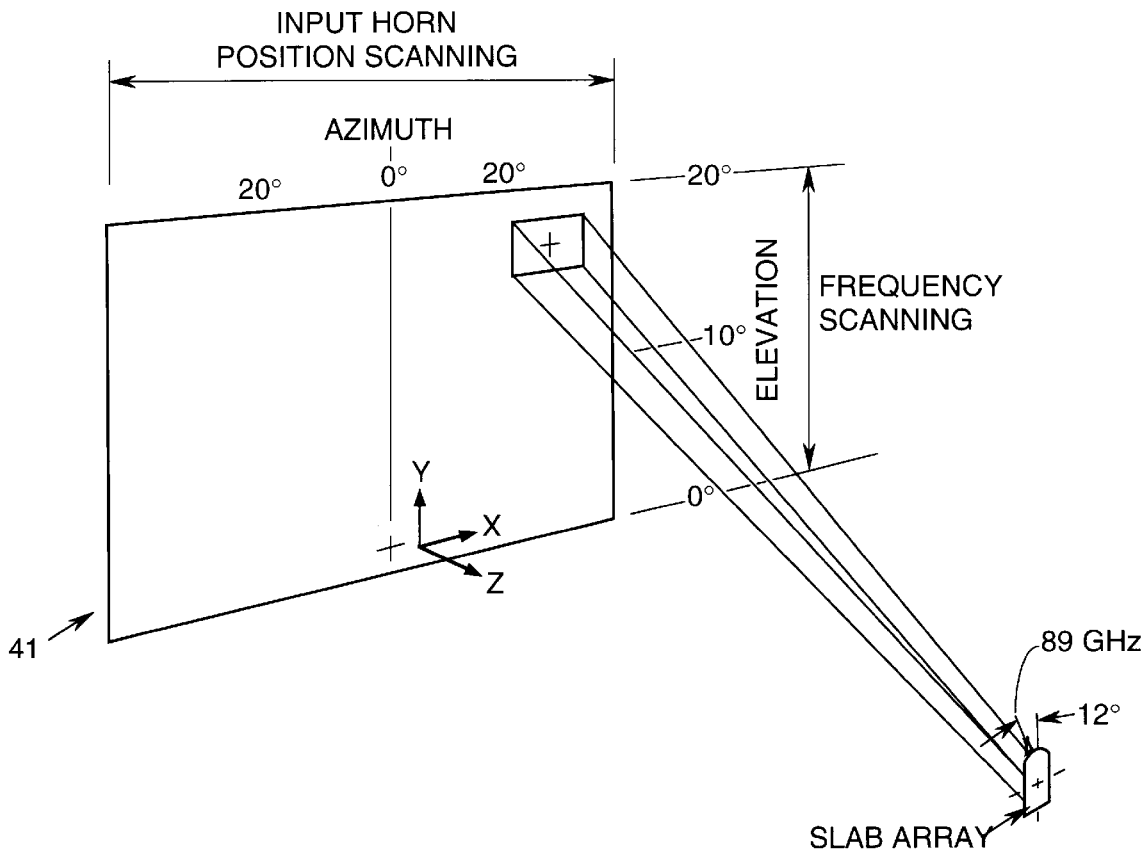
Figure 13D:
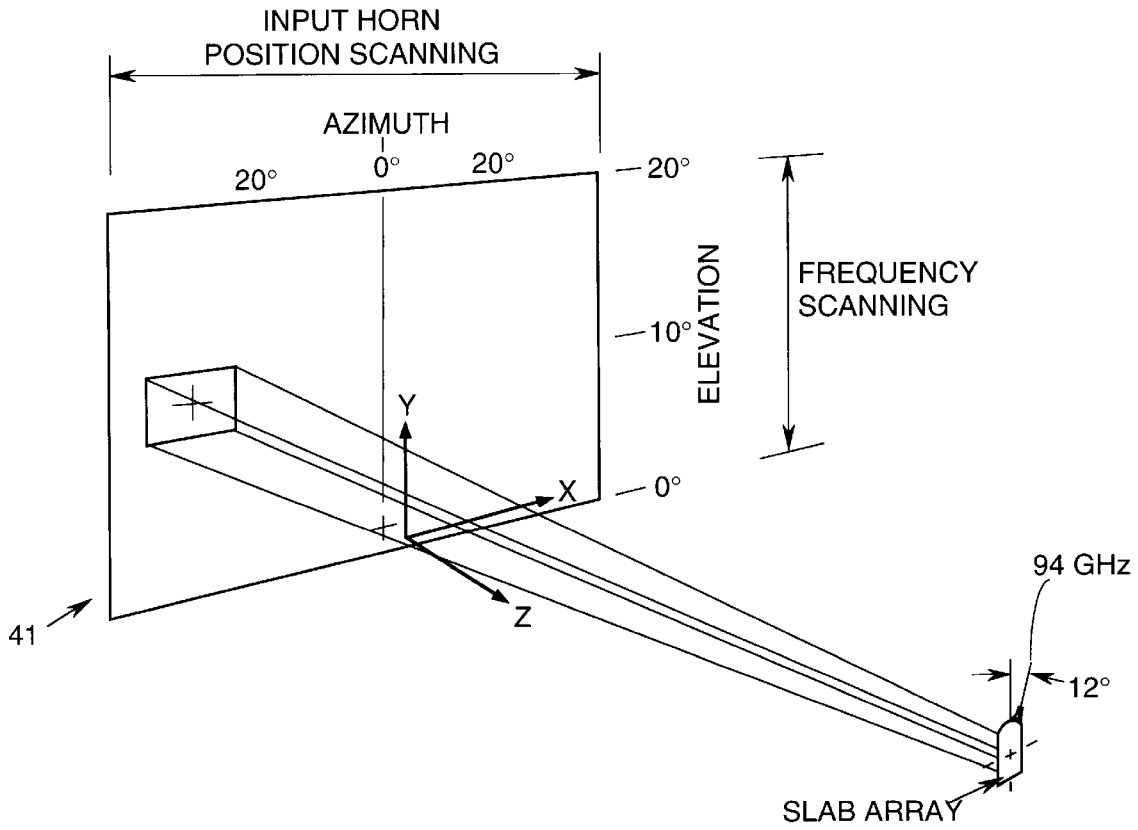

The relationships are shown pictorially in FIGS. 13A through 13D. Antenna 1 is pictured as positioned vertically (in an x-y plane). The cross near the bottom of screen 41 represents a point on the screen on a line drawn perpendicular to the plane of antenna 1 from the center of the face of antenna 1 (in a z direction). FIG. 13A shows the direction of a beam produced with a frequency of 89 GHz with the horn in the position shown in FIGS. 12A and 13A. The beam direction is 0° in azimuth and 17° in the vertical direction (0° representing a direction perpendicular to the plane of antenna 1). Shifting the horn 12° to the right as shown in FIG. 13B shifts the direction of the beam 20° to the left and shifting the horn 12° to the left as shown in FIG. 13C shifts the direction of the beam 20° to the right. Increasing the frequency of the beam to 94 GHz with the horn at 12° to the right produces a beam directed as shown in FIG. 13D which is 20° to the left in the azimuth plane and 10° above perpendicular in the vertical plane.

CONVERTING ANTENNA OUTPUT INTO IMAGES

Front End Electronics

In a preferred embodiment of the present invention the above described antenna is used as the microwave collector in a passive microwave camera (PMC). The electronic and optical equipment for converting the output of the antenna into images can be described by reference to FIGS. 16, 17 and 18.

Figure 16:
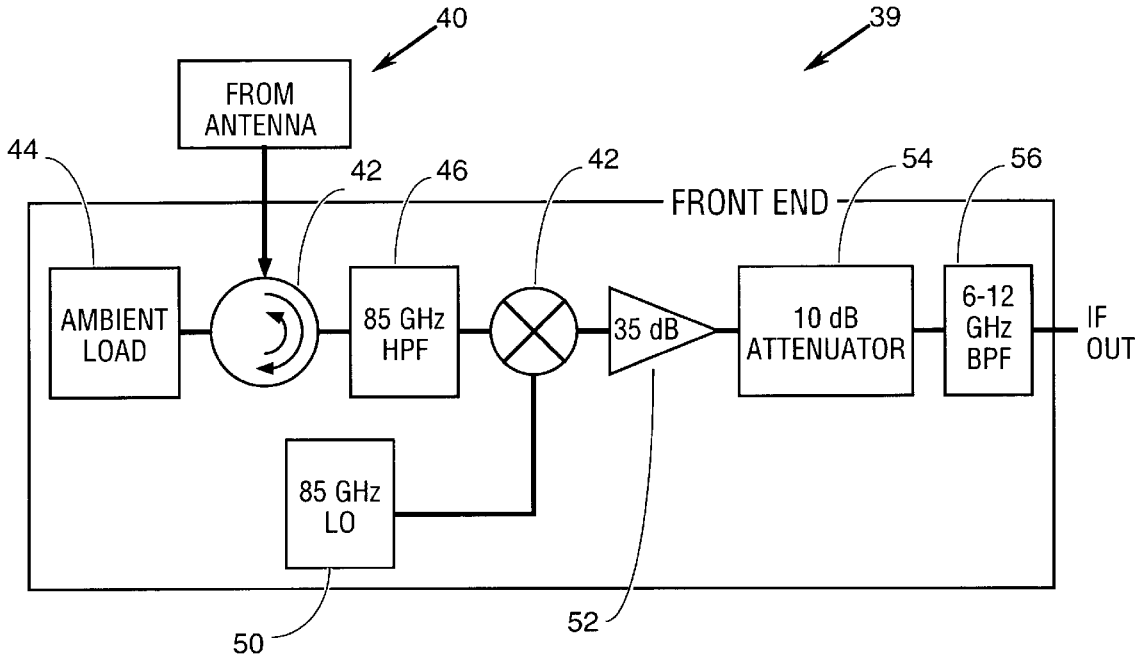
FIG. 16 is a block diagram of a first portion of an imaging system.

Front end electronics assembly 39 is described in FIG. 16. As shown in FIG. 16 at 40 the microwave output from antenna 1 is fed into a ferrite switching waveguide circulator 42 (supplied by Electro Magnetic Sciences with offices in Norcross, Ga.) acting as a single pole double throw Dicke switch. Circulator 42 alternates sampling of the signal 40 from antenna 1 and a signal from a fixed temperature reference load 44. This electronic toggling between the antenna and the fixed load is utilized for real-time compensation of the gain fluctuation of the camera.

The output of the switching circulator 42 is passed through highpass filter 46 which has a sharp microwave cut-off below 82.5 GHz which removes any thermal signals in the 73–79 GHz image band. Thermal microwave signals of interest (i.e., microwave signals in the range of 91–97 GHz) pass through filter 46 with minimal loss and are downconverted to 6–12 GHz by mixer 48 (supplied by Northeast Microwave Systems Inc. with offices in Concord, N.H.) by mixing an 85 GHz signal provided by a Gunn-oscillator 50 (part no. 47246H-1502, supplied by Millitech Corp. with offices in Deerfield, Mass.). The resulting 6–12 GHz signal is then amplified by about 35 dB with microwave amplifier 52 (Part No. NM-62, supplied by Electrodyne Systems with offices in South Hackensack, N.J.). The signal is then attenuated by 10 dB attenuator 54 and then filtered by 6–12 GHz bandpass filter 56 (Part No. 118 B10-900 supplied by K&L Microwave with offices in Los Angeles, Calif.) before being sent to optical processor interface electronics assembly 57 of FIG. 17 for further conversion.

Optical Processor Interface Electronics

Figure 17:
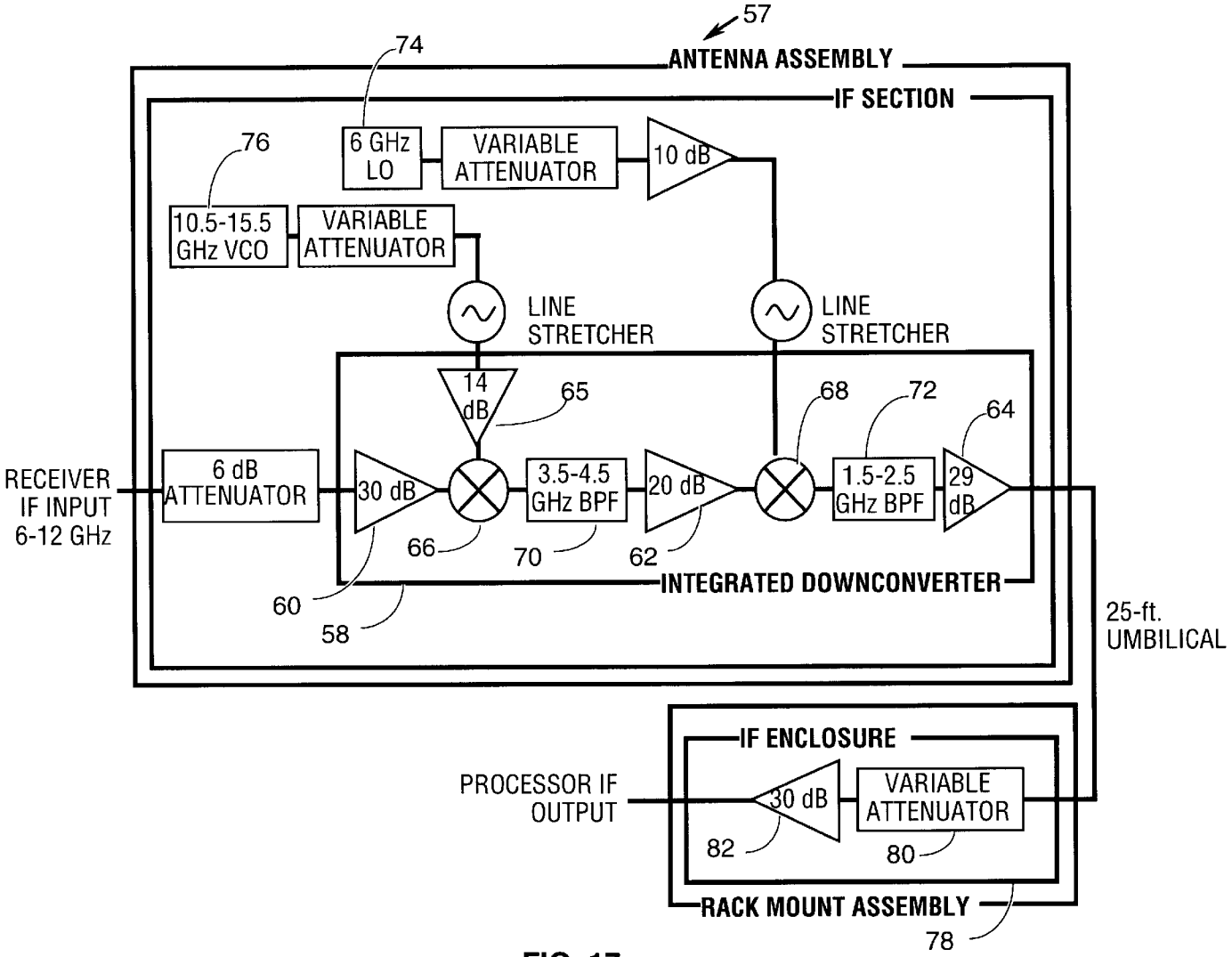
FIG. 17 is a block diagram of a second portion of the above imaging system.

Optical processor interface electronics assembly 57, shown in block diagram form in FIG. 17 takes the output signal from front end electronics assembly 39 and converts the signal to be compatible with the PMC optical processor 71.

The signal input to assembly 57 is in the frequency range of 6 to 12 GHz and at a power range of about 1 nW. The signal is converted in assembly 57 to a power level of about 1 mW and a frequency range of 1.5 to 2.5 GHz for driving an acoustic transducer. An integrated downconverter 58 is tuned for picking off selected 1 GHz wide subbands of the 6–12 GHz input, amplifying it by 66 dB, and mixing it down to a second frequency band of between 1.5 and 2.5 GHz. The downconverter is fed by an amplified 6 GHz oscillator 74 and a 10.5 to 15.5 GHz voltage controlled oscillator 76.

The downconverter unit 58 (Part No. ST MS-9106 supplied ST Microwave Corporation with offices in Sunnyvale, Calif.) comprises 3 gain stages: 30 dB at 6–12 GHz 60, 20 dB at 3.565 to 4.5 GHz 62, and 29 dB at 1.5 to 2.5 GHz 64; two mixers 66 and 68; a band pass filter at 3.5 to 4.5 GHz 51 and a bandpass filter 72 passing 1.5 to 2.5 GHz signals; and a 14 dB gain stage for a local oscillator signal for mixer 66. Downconverter unit 58 also comprises temperature and power regulators not shown. The unit provides a total gain of 66 dB for each of the six 1-GHz-wide subbands covering the 6 to 12 GHz input signal.

The six 1-GHz-wide subbands are selected utilizing voltage controlled oscillator 76. For example, the IF sub band between 6 GHz and 7 GHz (corresponding to a frequency subband between 91 and 92 GHz as detected by antenna 1 (see FIGS. 13A–13D) representing vertical beam directions between about 12 degrees and 14 degrees) is selected by tuning oscillator 76 to 10.5 GHz. This produces an output when mixed with the 6–12 GHz input of 3.5 to 9.5 GHz. However, filter 70 passes only the subband 3.5 to 4.5 GHz which is representative of the 6 to 7 GHz band. This signal is then mixed with the 6 GHz signal from oscillator 74 to produce frequency bands of 1.5 to 2.5 GHz and 9.5 to 10.5 GHz; however, filter 72 permits only the 1.5 to 2.5 GHz portion to pass. Similarly, the IF sub band between 8 GHz and 7 GHz (antenna frequency between 94 and 95 GHz and beam directions of between about 9 degrees and 10 degrees) is obtained by operating oscillator 76 at 12.5 GHz.

Figure 18:
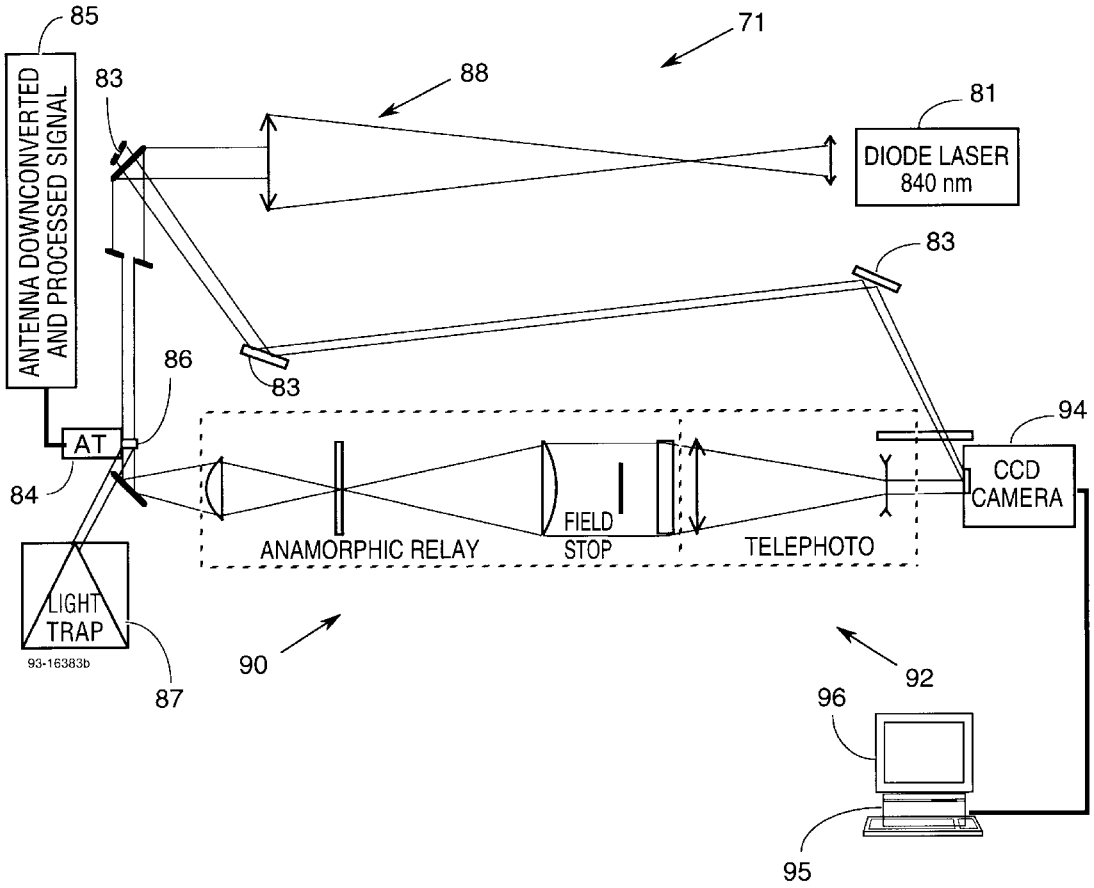
FIG. 18 is a block diagram of a third portion of the above imaging system.

The output of assembly 57 is fed to rack mount assembly 78 comprising a variable attenuator 80 and 30 dB amplifier 53 and the amplified output is fed to optical processor 71 shown in FIG. 18.

Optical Processor

Optical processor 71 converts the six 1-GHz-wide subbands into optical image information as shown in FIG. 18. The downconverted and processed signals from antenna 1

(see FIGS. 13A–13D) as indicated by block 85 are fed to an acoustic transducer 84 mounted along the top of Bragg cell 86 which is comprised of single crystal gallium phosphide. The transducer launches an acoustic wave which creates a diffraction grating in the crystal representing image information contained in the signal from antenna 1.

A 840 nm, 100 mW diode laser 81 (Part No. SDL-5411 supplied by Spectra Diode Labs with offices in San Jose, Calif.) provides a laser beam which is collimated to a 2.5 mm×7.5 mm elliptical beam (dimensions specified at the $1/\in^2$ intensity points) with an optical efficiency of 90% at a wavefront quality of $\lambda/4$. The beam is polarized along the minor axis of the ellipse. A thermoelectric cooler holds the diode temperature at 25° C. A diode laser driver (Type 203 supplied by Melles Griot, with offices in Irvine, Calif.) controls the laser drive current and the thermoelectric cooler. Typical laser power output is about 70 mW.

The collimated beam is expanded by a factor of five through a pair of lens assemblies 88 provided by Optics Plus Inc. of Santa Ana, Calif. The first assembly, designated XZAR-09 has a focal length of 50 mm and a clear aperture of 10 mm. The second lens assembly, designed XZAR-13, has a focal length of 250 mm and a clear aperture of 50 mm. Each lens has a transmitted-wavefront quality of $\lambda/20$ over the entire aperture, which adds negligible aberration to the beam's inherent $\lambda/4$ wavefront quality. The expanded beam is a 37.5-mm×12.5-mm ellipse.

The laser beam is directed to Bragg cell 86 where the diffraction grating set up in the Bragg cell by the processed antenna signal acting through acoustic transducer 84 diffracts the laser beam in a variety of directions depending on the frequency components of the acoustic beam. The zero order portion of the beam is captured in light trap 87.

The first order diffracted beam is directed to an anamorphic relay 90, comprised of a set of lenses, which expands the beam exiting the Bragg cell in a 1 to 23 expansion ratio to match the aspect ratio of the diffracted light exiting the Bragg cell with the aspect ratio of CCD pixel array of camera 94. Telephoto lens system 92 focuses the beam on to the CCD pixel array of camera 94. A small portion of the laser beam from laser 81 is directed by small mirrors 83 to a few pixels at the edge of the CCD pixel array of camera 94. Intensity information detected by these pixels is used to normalize image data for laser beam intensity variations.

Computer software in computer 95 provides for a sequential sampling of the six 1-GHz subbands of the antenna's frequency design frequency band (91 to 97 GHz corresponding to beam angles of between about 8 degrees and 13 degrees). This computer 95 a displays the results on monitor 96 by showing the image information as white, black and various shades of gray at appropriate locations on the screen of monitor 96.

Forming the Images

A one dimensional vertical image is created on monitor 96 by stacking six individual images representing the six subbands so that the image on the monitor represents the 5 degree (between 8 degrees and 13 degrees) vertical field of view of antenna 1. The width of the beam (in azimuth) provided by antenna 1 is about 2 degrees so that the images produced with horn 18 at the position shown in FIGS. 12A–12C is a one dimensional image with resolution only in the vertical direction and with a vertical field of view of about 5 degrees. Azimuthal resolution is provided by moving horn 18 to other positions such as those shown in FIG. 11 which changes the beam's azimuthal direction as indicated in FIG. 14B and FIGS. 13A, B and C. Thus, a composite image can be formed by stitching together a series of one-dimensional vertical images to form a 2-D image of a field of view of 8 degrees to 13 degrees in the vertical and +10 degrees to −10 degrees in azimuthal.

Figure 15A:
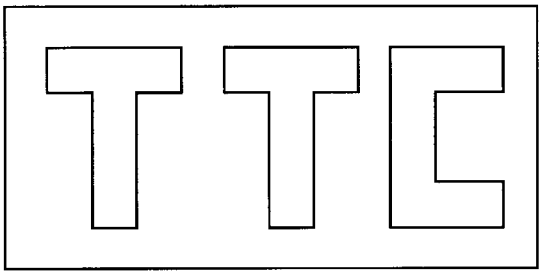
FIG. 15A is a drawing of a simple microwave emitting target.
Figure 15B:
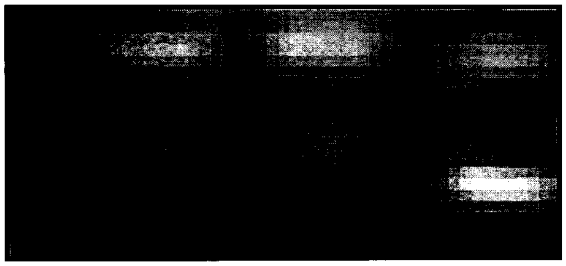
FIG. 15B is an image produced of the 15A target by microwave imaging system utilizing a prototype antenna built according to the teachings of the present invention.

FIG. 15B is a microwave image of a target image shown in FIG. 15A. The microwave image was obtained using Applicant's first prototype antenna constructed in accordance with the teachings of this specification. The target was the letters TTC (shown in FIG. 15A) created on a large plywood board with strips of one-foot wide aluminum foil. The board was positioned so the aluminum foil would reflect microwave radiation from a cloudless sky. The plywood radiated ambient temperatures at about 28° C. while the aluminum foil reflected radiation the cold sky representing a much lower temperature.

Other Embodiments

The above description is of a demonstration microwave antenna and camera system which has been built and tested by the Applicants to prove the principal features of the present invention. Persons skilled in the art will recognize many changes and improvements which could be applied to the system described above. Some of these improvements and modifications are discussed below.

As shown in FIG. 11 the antenna could be modified to provide an array of microwave horns so that beams from several or many azimuthal directions could be transmitted or received simultaneously. This would permit the obtaining of real time or close to real time 2-D images. In this case use of a multi-channel Bragg cell is recommended.

Modification to Antenna Design

Persons skilled in the art of antenna design will recognize that many modifications could be made to the antenna described in detail above to fit specific applications. As is very well known, increasing the antenna size will improve performance. The size of the slots may be specifically engineered to fit the application. Generally the length of each slot is set at a little less than one-half of the nominal wavelength of the microwave radiation of interest. Thus, in the example given we used a slot length of about 1.2 mm corresponding to a nominal microwave frequency of 94 GHz (3.19 mm wavelength). Preferred slot lengths are between about 10% to 40% of the midpoint of the wavelength range for which the antenna is designed. The spacing of the slots in the vertical direction should be established taking the nominal frequency of the radiation of interest into consideration and the equation for vertical angle, provided in the section entitled "Beam Pointing."

While the invention has been described by an example of an antenna which employs conductive layers substantially covering its upper and lower surfaces, it should be noted that the invention also includes antennas which are substantially devoid of such conductive layers. In such "pure" dielectric antennas, the coupling elements can be patches which are the compliment of slots. (Slots are holes in a metallic layer, while patches are most often metal islands surrounded by the absence of conductor.) Patches can also be formed by a non-conductive material. Such patches are called dielectric patches and the dielectric constant of such patches can be any value other than that of the medium (usually either air, for terrestrial applications, or vacuum for outer space applications) in which the antenna is used. Other examples of elements which can be used with "pure" dielectric antennas include grooves which are cut into the surface of the dielectric slab, and projections which protrude above the surface of the dielectric (these are equivalent to dielectric patches in the special case where the dielectric constant of the patch is equal to the dielectric constant of the slab). So-called "pure" dielectric antennas can also utilize elements which are placed on the back, or second, surface of the slab. Interference effects between the front and back elements can be used to direct outgoing electromagnetic waves out the front surface. Also, for antennas which use conductors covering substantial portions of one or both surfaces, frequency selective surfaces can be employed. The advantage of using such surfaces is that the antenna can be made transparent to electromagnetic radiation at wavelengths which the antenna does not use. The utility in doing this is to allow an antenna of the present invention to be placed directly in front of another antenna to save weight and/or space. For example, this approach can be used to place an antenna of the present invention, in front of a weather radar antenna in an airplane.

The preferred mode of the instant invention is the TEM-mode. The TEM-mode has the unique property that it is very insensitive to dimensional variations of the thickness of the dielectric slab. This is in stark contrast to the conventional TE and TM modes which impose very strict limits on variations of the thickness of the dielectric slab. An additional reason that the TEM-mode is preferred is that it is a very low loss mode.

Alternative Lens Systems

The antenna described above has an active area of only about 4 inches×6 inches therefore the resolution of a camera using this antenna and operating near 90 GHz would be limited to about 1.5°. For better resolution the antenna can be made larger or even much larger. The active area of the antenna in fact could be meters across. For these larger antennas a more compact lens system could be utilized to focus the microwave energy collected by the antenna.

The lens should be capable of focusing electromagnetic waves propagating in a variety of directions in a thin layer waveguide to a series of small spots or focal locations, each spot corresponding to a direction of propagation. Many well known lenses are available to accomplish this and they are described in antenna reference books such as Antenna Engineering Handbook, edited by Johnson and Jack and Published by McGraw Hill Book Company with offices in Long Island, N.Y. (See subchapter 16-6.) Lenses which could be used include two dimensional bootlace-type lenses such as a Rottman-Turner lens or an Archer lens. These lenses contain transmission lines with equal time delays carrying rays from a focal point to a corresponding linear wave front. Luneburg lenses and geodesic lenses are examples of other lenses which could be used.

Figures 19A, 19B, 19C:
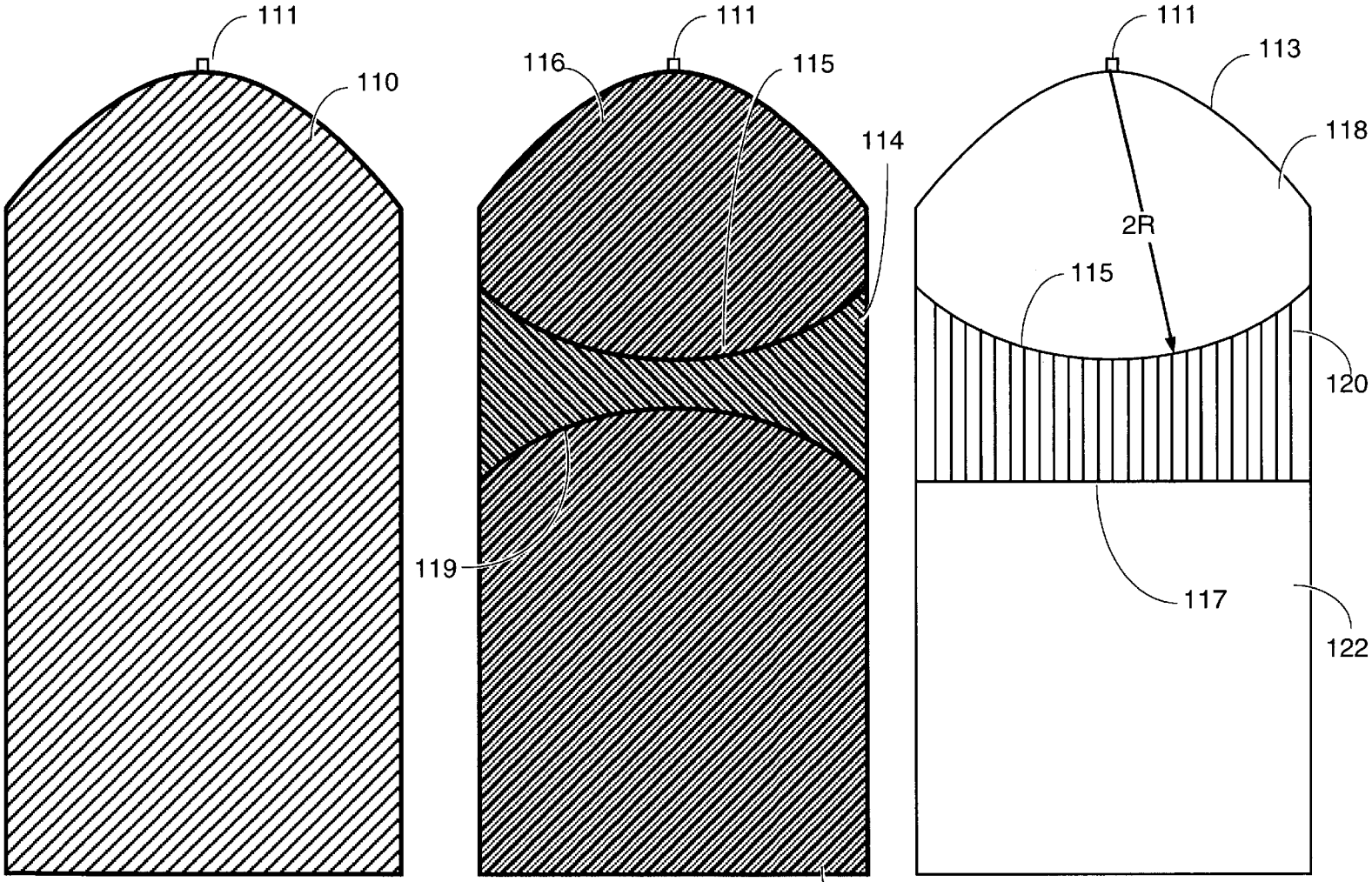
FIGS. 19A, 19B, and 19C are three views of a preferred embodiment of the present invention.

For larger antennas our preferred lens is a variation of the Archer/Rottman-Turner lens. An Archer/Rottman-Turner variation is shown in FIGS. 19A, B and C. In this lens, a microwave focal arc is defined by a radius R (approximately). From a central point 111 on the focal arc, a lens output surface of radius 2×R is defined as being the output surface (i.e. transmit mode). At this 2×R distance, the radiation from the central point on the focal arc is exactly in-phase at all points. Radiation from other points on the focal arc 113 is displaced by a linear (approximately) phase slope term directly proportional to the location of the feed point displacement from the central position on the focal arc.

On the output surface 115 of the lens, energy is picked up by strip transmission lines 120 and routed through equal electrical length strip lines to the plane wave point 117 on the input to the dielectric slab 112. To achieve the equal electrical length strip lines (which are not physically equal in length) the strip lines each pass through a different length of dielectric loading (i.e., a second lens 119). Strip lines on the edge of the array pass through a dielectric region 114 with small dielectric loading while strip lines in the central region of the array pass through a dielectric loading length sufficient to make the lines electrically equal. This is a line compensation lens which appears between the Rottman-Turner lens and the dielectric slab array area. This lens is similar in many respects to the piano convex lens previously described. Several advantages are noted for this configuration such as: 1) the focal length of the lens is such that an open ended waveguide feed instead of a feed horn may be effectively employed without excessive feed losses. This allows for closer spacing of input feeds without excessive loss. Moreover, the larger area of the Rottman-Turner lens may be dielectric filled which provides simple low cost construction with a minimal structural requirement to maintain the gap between top and bottom surfaces of the lens.

Alternate Imaging Systems

Embodiments of antennas constructed in accordance with the present invention collect microwave signals in relatively narrow beams in determinable directions (or they can transmit narrow beams in predetermined directions). The frequency of collected microwave radiation determines the directions in a first dimension from which the radiation came. The places at which microwave radiation comes to focus in the antenna determines the direction from which the radiation comes in a second dimension. Many potential techniques are available to utilize these two sets of information to create two dimensional images.

Bragg cells are available with 32 channels; therefore, a preferred method of creating 2-D images would be to feed each of the 32 Bragg cell channels from one of 32 separate horn mounted along the focal plane of the antenna as suggested by FIG. 11. Bragg cells can be fabricated with many more channels, such as 64 channels, so for a larger antenna it would be feasible to have a large number of corresponding horns and Bragg cell channels to provide a greater number of pixels.

The Bragg cell system could be replaced with an electro-optic processor for converting microwave information from the antenna into images.

Subresonant Slots

The slots depicted in FIG. 6 and described above for the preferred prototype device are examples of subresonance slots (i.e., slots with the major dimension of about 0.1 to 0.4 $\lambda$, where $\lambda$ is the nominal wavelength for which the antenna is designed). A resonant slot would be a slot with its major dimension approximately equal to one-half the nominal wavelength. Other examples of subresonant elements include apertures of any shape which penetrate through the top conductive layer of the antenna. (For so-called "pure" dielectric slab antennas, the subresonant elements may be patches, grooves, etc. as described earlier). Resonant slots would not work as well for the preferred embodiment and will not work as well for many applications because designs with resonant slots use slot angle to control coupling. Use of slot angle to control coupling in applications such as the described preferred embodiment is not feasible as is evident from FIGS. 12A, 12B and 12C.

The coupling coefficients of these subresonance slots is small but we can make up for the smallness by using a large number of slots. The coupling coefficient is proportional to the sixth power of the perimeter of the slot described by the radiation one-half wavelength plus or minus a feed efficiency factor which depends on lateral spacing and parallel plate mode of operation (e.g., TEM mode which is utilized in the above described preferred embodiment).

The subresonance slots (which we sometime refer to as "iris radiating elements" or "irises") will work for modes other than TEM, such as TE or TM modes of propagation, but the TEM mode is preferred. The wave propagation in the dielectric slab creates a phase delay in the excitation of leading and trailing edges of the slot. For the TEM mode, this phase delay induces a voltage across the slot which in turn generates a change displacement around the edges of the slot. This charge displacement induces a small amount of radiation out of the top surface.

The voltage across the iris is fixed by propagation delays through the dielectric medium which makes the voltage created an inverse function of both length and width of the iris (i.e, $\sim 1/(L+W)$ for the TEM mode while radiation current flow is dominated by a reactance term that varies inversely with the cube of both width and length (i.e. $\sim 1/(L-W)^3$) and the radiation resistance varies as an inverse square function of length $\sim(1/L)^2$. As a result of the combination of these factors, a sixth power variation in power coupling efficiency was expected and was measured for the small slots employed in the demonstration system. The sixth power variation of coupling as function of length means that the very small coupling coefficients needed for large end-feed arrays may be obtained with ease. Moreover, the coupling is minimally impacted by the direction of power flow within the slab.

For many embodiments, the preferred slot shape is one with a long dimension and a short dimension, such as shown in FIG. 6. However, other subresonant shapes are possible and would be preferred in some applications. Round holes were also found to be equally effective and followed approximately the same coupling variation with size. These were used in a 210 GHz antenna tested using the TE mode of propagation in the dielectric medium. For example, round holes might be used in a square antenna fed from two perpendicular directions.

For particular applications, it may be important to extract power from the antenna at a constant rate along the length of the antenna. This can be done by making slots gradually larger as a function of distance from the input end. Techniques for determining slot sizes to do this are well known. Generally, for normal size antennas, the slots at the terminal end of the antenna would grow to about twice as large as those at this entrance end in order to achieve roughly constant output along the length of the antenna.

Applications of Antenna Without a Lens

Figure 20:
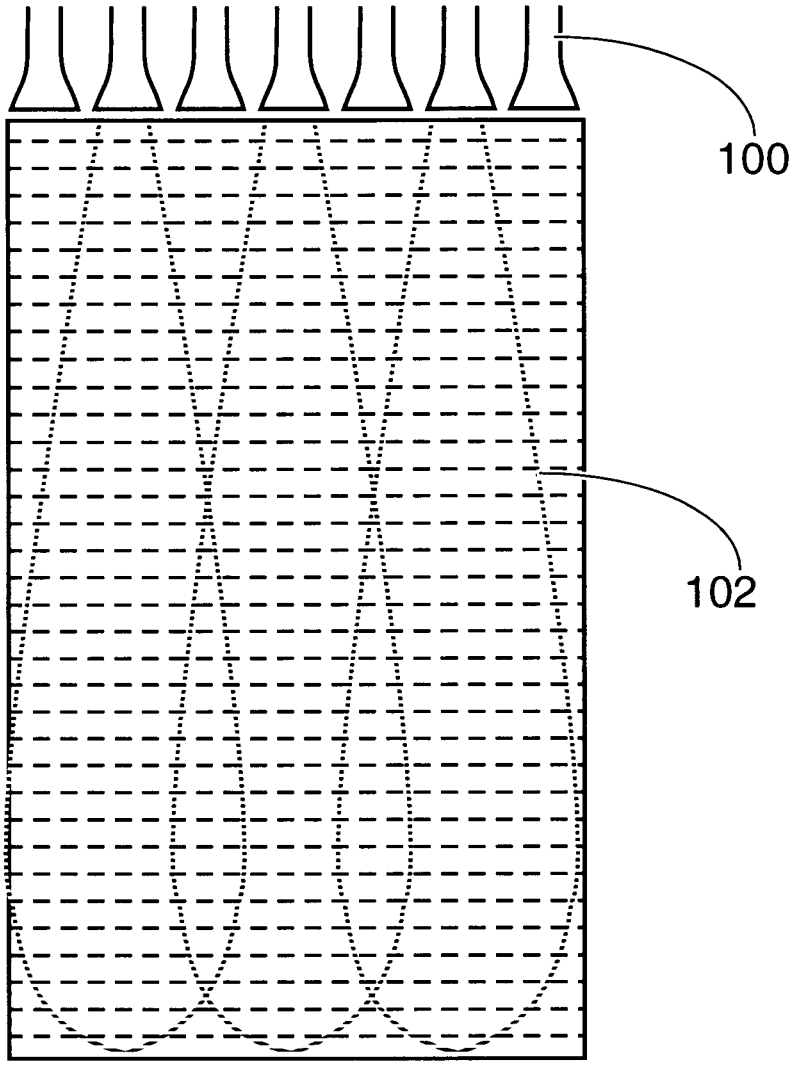
FIG. 20 is a drawing of a lensless antenna.

The contemporary approach to building high gain arrays employs end-fed waveguide elements with resonant slots cut at angles to adjust the coupling coefficient. While the resonant slots have limited applications in the dielectric slab array, the dielectric slab may be directly substituted for an array of waveguide elements by placing multiple feeds on an input edge of the slab to emulate multiple waveguide elements. The radiation from each of these multiple feed inputs is controlled by the internal radiation pattern (i.e., inside the dielectric slab) of the feed elements emulating the waveguide inputs. As the radiation propagates down the dielectric slab, the individual slot (iris) radiators on the surface of the slab extracts portions of the energy and radiates the extracted energy to form a beam in a propagation direction that is defined by the length of the dielectric slab and the coupling coefficient of the individual slots. In the cross plane, the slots take the line integral of the radiation from the feed source and radiates a cross beam pattern that is defined by the beam-width of the input feed element. (Such an antenna, without lens, is shown in FIG. 20. Horns 100 produce beam patterns 102 which spread out as the beam passes through the dielectric but the radiation output from the antenna is similar to that of an antenna formed with a slotted waveguide.) The net result is that the pattern of the radiation from the radiating aperture is exactly defined by the cross pattern of the input feed and the along axis pattern of the radiating slotted surface. To this extent it exactly emulates a slotted end-fed waveguide radiator with a horn in the cross plane having the same pattern as the input feed pattern in the dielectric slab multiplied in width by the Snell's law diffraction at the surface of the dielectric slab. For a dielectric constant of 2.54 used in the experiments, this increases the cross-slab beam width by 1.59 times the internal slab feed beamwidth.

The merit of employing multiple feeds as described to emulate an array of slotted wave-guide antennas is that the cost of the dielectric slab approach is much lower cost construction and in most cases lower loss than the waveguide.

CONCLUSION

While the above description contains many specifications, the reader should not construe these a limitation on the scope of the invention, but merely as exemplifications of preferred embodiments thereof. Accordingly the reader is requested to determine the scope of the invention by the appended claims and their legal equivalents, and not by the examples given above.

What is claimed is:

1. A microwave antenna having a movable feed, said microwave antenna comprising:

a thin layer radiating-receiving microwave waveguide section having:

1) a conductive first plate;

2) a dielectric slab disposed on said conductive first plate and having a convex edge, positioned such that the convex edge functions as a microwave lens with respect to incident microwave radiation;

3) a conductive radiating-receiving second plate defining a radiating-receiving area, disposed on said dielectric slab, said second plate comprising a plurality of spaced apertures, said plurality of spaced apertures defining a spacing chosen to produce or define microwave beams having directions into or out of said second plate determined by directions of propagation of microwave radiation within said radiating-receiving microwave waveguide section, and wherein the feed propagates microwave radiation into, or receives microwave radiation from, an air cavity formed by said first and second conductive plates, and wherein wavefronts of the microwave radiation incident on said convex edge of the dielectric slab are made substantially parallel to each other, and wherein the horizontal direction of microwave radiation radiated from the dielectric slab is controlled by corresponding horizontal movement of the feed.

2. An antenna as in claim 1 wherein:

a) said waveguide section is designed to operate within a frequency band, said band defining a highest design frequency and a lowest design wavelength, and b) said dielectric slab thickness is less than about 40% of said lowest design wavelength.

3. An antenna as in claim 1 wherein:

a) said microwave lens comprises an extension of said dielectric slab having an edge defining an arc of a first circle having, a center within said slab, and b) said microwave lens is arranged, in a receiving mode, to focus microwave radiation propagating in said thin layer radiating-receiving waveguide section at a plurality of locations, each location defining a focal radiation in said thin layer radiating-receiving waveguide section, and wherein said plurality of focal locations are located on an arc of a second circle having the same center as said first circle.

4. An antenna as in claim 1, further comprising at least one transmitting-receiving microwave element for performing at least one of the following functions: 1) in the receiving mode, receiving microwave energy from said thin layer radiating-receiving microwave waveguide section focused at said plurality of focal locations, and 2) in the transmitting mode, transmitting microwave energy from said plurality of apertures into said thin layer radiating-receiving microwave section, and wherein said at least one transmitting-radiating-receiving microwave element is a microwave horn.

5. An antenna as in claim 1, wherein said plurality of apertures is at least 500 apertures.

6. An antenna as in claim 1 wherein said first plate, said dielectric slab and said radiating-receiving second plate each has a surface area of at least 10 square inches.

7. An antenna as in claim 1, further comprising at least one transmitting-receiving microwave element for performing at least one of the following functions: 1) in the receiving mode, receiving microwave energy from said thin layer radiating-receiving microwave waveguide section focused at said plurality of focal locations, and 2) in the transmitting mode, transmitting microwave energy from said plurality of apertures into said thin layer radiating-receiving microwave section, and wherein said at least one transmitting-radiating-receiving microwave element is an open ended waveguide.

8. An antenna as in claim 4 wherein said at least one transmitting-radiating-receiving microwave element is a plurality of microwave horns.

9. An antenna as in claim 1 wherein said microwave lens is a boot-lace type lens.

10. An antenna as in claim 1 wherein said microwave lens is chosen from a group of lenses consisting of: a Rottman-Turner lens an Archer lens, a geodesic lens, and a Luneburg lens.

11. An antenna as in claim 1 designed to function within a frequency band of microwave radiation defining a midpoint wavelength wherein said dielectric slab has a thickness of between about 20% and about 60% of said midpoint wavelength.

12. An antenna as in claim 7 wherein said dielectric slab has a thickness of about 40% of said midpoint wavelength.

13. A microwave antenna as in claim 1 and further comprising an imaging system for producing, from microwave radiation collected by said antenna from a field of view, images of objects in said field of view.

14. A microwave imaging system comprising:

A) a microwave antenna comprised of:

1) a thin layer radiating-receiving microwave waveguide section comprised of:

a) a metallic bottom plate, b) a dielectric slab disposed on said metallic bottom plate, c) a metallic radiating-receiving cover plate defining a radiating-receiving area, disposed on said dielectric slab, said cover plate comprising a plurality of spaced slots, said spaced slots defining a regular spacing chosen to produce or define microwave beams having directions into or out of said cover plate determined by directions of propagation of TEM microwave radiation within said radiating-receiving microwave waveguide section;

2) a microwave lens arranged to perform at least one of the following functions:

a) in a radiating-receiving mode, focus TEM microwave radiation propagating in said thin layer radiating-receiving waveguide section at a plurality of locations, each location defining a focal location and each of said focal locations corresponding to a direction of travel to TEM microwave radiation in said thin layer radiating-receiving waveguide section, and b) in a radiating mode, to produce in said thin layer radiating-receiving waveguide section microwave beams having substantially linear wavefronts from microwave radiation from any one of said focal locations;

3) at least one transmitting-radiating-receiving microwave element for performing at least one of the following functions:

1) in a radiatin-receiving mode, radiating-receiving microwave energy from said thin layer radiating-receiving microwave waveguide section focused at said plurality of focal locations, and 2) in a transmitting mode, transmitting microwave energy from said plurality of slots into said thin layer radiating-receiving microwave section;

B. a processing system comprised of:

1) front end electronics for converting microwave radiation collected by said antenna into corresponding signals at lower frequencies;

2) processor interface electronics for said lower frequency signals into a plurality of frequency subbands; and 3) a processor for converting said frequency subbands into optical images.

15. An image system as in claim 14 wherein said processor is an optical processor.

16. An imaging system as in claim 15 wherein said optical processor comprises:

a) a Bragg cell, b) an acoustic transducer attached to said Bragg cell for generating diffraction gratings in said Bragg cell from signal information contained in said frequency subbands, c) a laser for producing a laser beam directed at said Bragg cell, and d) an optical detector for detecting laser radiation diffracted from said Bragg cell and forming an image from information contained in said diffracted radiation.

17. An image system as in claim 14 wherein said processor is an Archer processor.

18. A microwave antenna for radiating-receiving or transmitting microwave radiation within a frequency band defining a minimum wavelength corresponding to the highest frequency in said frequency band comprising:

A) a dielectric slab defining edges, a radiating-receiving surface, and an opposite surface, and having a convex edge, such that the convex edge functions as a microwave lens;

B) at least one movable transmitting-radiating-receiving microwave element for performing at least one of the following functions:

1) in a radiating-receiving mode, radiating-receiving microwave energy from at least one edge of said dielectric slab, and 2) in a transmitting mode, transmitting microwave energy into at least one edge of said dielectric slab, C) a plurality of subresonant radiating-receiving elements arranged to couple microwave energy into or out of said dielectric slab through said radiating-receiving surface;

wherein said at least one movable transmitting-radiating-receiving microwave element propagates microwave radiation into, or receives microwave radiation from, an air cavity formed by said at least one edge of the dielectric slab and said at least one movable transmitting-radiating-receiving microwave element, and wherein wavefronts of the microwave radiation incident on said convex edge of the dielectric slab are made substantially parallel to each other, and wherein the horizontal direction of microwave radiation radiated from the dielectric slab is controlled by corresponding horizontal movement of said at least one movable transmitting-radiating-receiving microwave element.

19. An antenna as in claim 18 wherein said radiating-receiving elements comprise grooves in said dielectric slab or slots in a metal cover plate.

20. An antenna as in claim 18 wherein said radiating-receiving elements comprise patches disposed on said dielectric slab.

21. An antenna as in claim 20 wherein said patches are metal patches.

22. An antenna as in claim 20 wherein said patches are dielectric patches.

23. An antenna as in claim 18 wherein said radiating-receiving elements comprise grooves in said dielectric slab.

24. An antenna as in claim 18 designed to operate in a TEM mode wherein said dielectric slab has a thickness of less than about 50% of said minimum wavelength.

25. An antenna as in claim 18 further comprising a multi-focal microwave element defining a focal plane, said multi-focal microwave element arranged to focus microwave energy at a plurality of locations on said focal plane depending upon angles of incidence of microwave energy incident upon said dielectric slab.

26. An antenna as in claim 25 wherein said multi-focal microwave element is a dielectric lens.

27. An antenna as in claim 26 wherein said dielectric lens is a piano-convex lens.

28. An antenna as in claim 26 wherein said dielectric lens is a wide angle lens.

29. A microwave antenna for radiating-receiving or transmitting microwave radiation within a frequency band defining a minimum wavelength corresponding to the highest frequency in said frequency band, and having a feed, said microwave antenna comprising:

A) a dielectric slab having a thickness of less than one-half said minimum wavelength, said slab defining edges, a radiating-receiving surface and an opposite surface, and having a convex edge, such that the convex edge functions as a microwave lens;

B) at least one transmitting-radiating-receiving microwave element for performing at least one of the following functions:

1) in radiating-receiving mode, radiating-receiving microwave energy from at least one edge of said dielectric slab, and 2) in a transmitting mode, transmitting microwave energy into at least one edge of said dielectric slab, wherein the feed propagates microwave radiation into, or receives microwave radiation from, an air cavity formed by said first and second conductive plates, and wherein wavefronts of the microwave radiation incident on said convex edge of the dielectric slab are made substantially parallel to each other, and wherein the horizontal direction of microwave radiation radiated from the dielectric slab is controlled by corresponding horizontal movement of the feed.

30. An antenna as in claim 29 and further comprising a plurality of subresonant radiating-receiving elements, arranged to couple microwave energy into or out of said dielectric slab through said radiating-receiving surface.

31. An antenna as in claim 30 wherein said radiating-receiving elements comprise grooves in said dielectric slab or slots in a metal cover plate.

32. An antenna as in claim 30 wherein said radiating-receiving elements comprise patches disposed on said dielectric slab.

33. An antenna as in claim 32 wherein said patches are metal patches.

34. An antenna as in claim 32 wherein said patches are dielectric patches.

35. An antenna as in claim 30 wherein said radiating-receiving elements comprise grooves in said dielectric slab.

36. An antenna as in claim 30 and further comprising a multi-focal microwave element defining a focal plane, said multi-focal microwave element arranged to focus microwave energy at a plurality of locations on said focal plane depending upon angles of incidence of microwave energy incident upon said dielectric slab.

37. An antenna as in claim 36 wherein said multi-focal microwave element is a dielectric lens.

38. An antenna as in claim 36 wherein said dielectric lens is a plano-convex lens.

39. An antenna as in claim 36 wherein said dielectric lens is a wide angle lens.

40. A microwave antenna having a feed including a microwave lens, comprising:

a thin layer radiating-receiving microwave waveguide section having:

1) a conductive first plate;

2) a dielectric slab disposed on said conductive first plate, and having a convex edge, such that the convex edge functions as a microwave lens;

3) a conductive radiating-receiving second plate defining a radiating-receiving area, disposed on said dielectric slab, said second plate comprising a plurality of spaced slots, said plurality of spaced slots defining a spacing chosen to produce or define microwave beams having directions into or out of said second plate determined by directions of propagation of microwave radiation within said radiating-receiving microwave waveguide section, and wherein said waveguide section is designed to operate within a frequency band, said band defining a highest design frequency and a lowest design wavelength, and wherein the feed propagates microwave radiation into, or receives microwave radiation from, an air cavity formed by said first and second conductive plates, and wherein wavefronts of the microwave radiation incident on said convex edge of the dielectric slab are made substantially parallel to each other, and wherein the horizontal direction of microwave radiation radiated from the dielectric slab is controlled by corresponding horizontal movement of the feed.

41. A microwave antenna for receiving or transmitting microwave radiation within a frequency band defining a minimum wavelength corresponding to the highest frequency in said frequency band comprising:

A) a dielectric slab defining edges, a radiating-receiving surface, and an opposite surface, and having a convex edge, such that the convex edge functions as a microwave lens;

B) at least one transmitting-receiving microwave element for performing at least one of the following functions:

1) in a receiving mode, receiving microwave energy from at least one edge of said dielectric slab, and 2) in a transmitting mode, transmitting microwave energy into at least one edge of said dielectric slab, wherein a feed propagates microwave radiation into, or receives microwave radiation from, an air cavity formed by first and second conductive plates, and wherein wavefronts of the microwave radiation incident on said convex edge of the dielectric slab are made substantially parallel to each other, and wherein the horizontal direction of microwave radiation radiated from the dielectric slab is controlled by corresponding horizontal movement of the feed;

C) a plurality of radiating-receiving elements, each element having a major dimension less than about 40% of said minimum wavelength and arranged to couple microwave energy into or out of said dielectric slab through said radiating-receiving surface.

42. A microwave antenna having a feed including a microwave lens, comprising:

a thin layer radiating-receiving microwave waveguide section having:

1) a conductive first plate;

2) a dielectric slab disposed on said conductive first plate, and having a convex edge, such that the convex edge functions as a microwave lens;

3) a conductive radiating-receiving second plate defining a radiating-receiving area, disposed on said dielectric slab, said second plate comprising a plurality of spaced apertures, said plurality of spaced apertures defining a spacing chosen to produce or define microwave beams having directions into or out of said second plate determined by directions of propagation of microwave radiation within said radiating-receiving microwave waveguide section, and wherein the feed propagates microwave radiation into, or receives microwave radiation from, an air cavity formed by said first and second conductive plates, and wherein wavefronts of the microwave radiation incident on said convex edge of the dielectric slab are made substantially parallel to each other, and wherein the horizontal direction of microwave radiation radiated from the dielectric slab is controlled by corresponding horizontal movement of the feed.

* * * * *